US006617773B1

(12) United States Patent
Yamamoto et al.

(10) Patent No.: US 6,617,773 B1
(45) Date of Patent: Sep. 9, 2003

(54) ELECTRON-EMITTING DEVICE, ELECTRON SOURCE, AND IMAGE-FORMING APPARATUS

(75) Inventors: Keisuke Yamamoto, Yamato (JP); Miki Tamura, Isehara (JP); Yutaka Arai, Atsugi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/454,963

(22) Filed: Dec. 6, 1999

(30) Foreign Application Priority Data

Dec. 8, 1998 (JP) ..... 10-348560
Dec. 2, 1999 (JP) ..... 11-342811

(51) Int. Cl.[7] ..... H01J 1/00
(52) U.S. Cl. ..... 313/310; 313/311; 313/495
(58) Field of Search ..... 313/310, 311, 313/512, 495

(56) References Cited

U.S. PATENT DOCUMENTS

| | | | | |
|---|---|---|---|---|
| 5,066,883 A | * | 11/1991 | Yoshioka et al. | 313/309 |
| 5,327,050 A | | 7/1994 | Tsukamoto et al. | 313/363 |
| 5,578,897 A | * | 11/1996 | Nomura et al. | 313/310 |
| 5,608,283 A | * | 3/1997 | Twichell et al. | 313/309 |
| 5,659,328 A | * | 8/1997 | Todokoro et al. | 345/74 |
| 5,729,094 A | * | 3/1998 | Geis et al. | 315/169.1 |
| 5,984,752 A | * | 11/1999 | Tanaka et al. | 445/51 |
| 6,246,168 B1 | * | 6/2001 | Kishi et al. | 313/309 |

FOREIGN PATENT DOCUMENTS

| | | |
|---|---|---|
| EP | 0701265 A1 | 3/1996 |
| EP | 0725414 A1 | 8/1996 |
| JP | 64-31332 | 2/1989 |
| JP | 1-283749 | 11/1989 |
| JP | 2-257552 | 10/1990 |
| JP | 90-17325 | 1/1997 |
| JP | 9-265893 | 10/1997 |
| JP | 9-265894 | 10/1997 |
| JP | 9-274844 | 10/1997 |
| JP | 9-330654 | 12/1997 |
| JP | 2836015 | 10/1998 |
| JP | 2903295 | 3/1999 |
| JP | 11-306959 | 11/1999 |
| JP | 2000-173452 | 6/2000 |
| JP | 2000-173453 | 6/2000 |

OTHER PUBLICATIONS

M. Geis, et al., Electron Field Emission From Diamond and Other Carbon Materials After $H_2$, $O_2$ Cs Treatment, Appl. Phys. Left. 67(9), Aug. 28, 1995, pp. 1328–1330.

K. Okano et al., Low–Threshold Cold Cathodes Made Of Nitrogen–doped Chemical–vapour–deposited Diamond, Nature, vol. 381, May 9, 1996, pp. 140–141.

G. Amaratunga, et al., Nitrogen Containing Hydrogenated Amorphous Carbon for Thin–film Field Emission Cathodes, Appl. Phys. Lett. 68(18), Apr. 29, 1996, pp. 2529–2531.

E. Joon Chi, et al., Effects of Heat treatment on the Field Emission Property of Amorphous Carbon Nitride, J. Vac. Sci. Technol. B 16(3), May/Jun. 1998, pp. 1219–1221.

(List continued on next page.)

*Primary Examiner*—Ashok Patel
*Assistant Examiner*—Glenn Zimmerman
(74) *Attorney, Agent, or Firm*—Fitzpatrick, Cella, Harper & Scinto

(57) ABSTRACT

Provided is an electron-emitting device which can be applied to an image-forming apparatus for displaying images with high luminance and high quality stably over a long period. The electron-emitting device has first and second carbon films laid on a substrate and first and second electrodes electrically connected to the respective carbon films, a higher voltage is applied to the second electrode than to the first electrode, and the carbon film connected to the second electrode comprises nitrogen.

11 Claims, 17 Drawing Sheets

OTHER PUBLICATIONS

A. Weber, et al., Carbon Based Thin Film Cathodes for Field Emission Displays, J. Vac. Sci. Technol. A (16(3), May/Jun. 1998, pp. 919–921.

C.A. Spindt et al., "Physical Properties of Thin Films of Thin–film Field Emission Cathodes with Molybdenum Cases", J. Applied Physics, vol. 47, No. 12, Dec. 1976, pp. 5248–5263.

C.A. Mead, "Operation of Tunnel–Emission Devices," J. Applied Physics, vol. 32, No. 4, Apr. 1961, pp. 646–652.

W.P. Dyke et al., "Field Emission", Advances in Electronics and Electron Physics, 1956, pp. 89–185.

M. Elinson, et al. "The Emission of Hot Electrons and the Field Emissions of Electrons From Tin Oxide", Radio Engineering and Electronic Physics, Jul. 1965, pp. 1290–1296.

G. Dittmer, "Electrical Conduction and Electron Emission of Discontinuous Thin Films", Thin Solid Films, 9, 1972 pp. 317–328.

M. Hartwell et al., "Strong Electron Emission From Patterned Tin–Indium Oxide Films", IEDM, 1975, pp. 519–521.

H. Araki, et al., "Electroforming and Electron Emission of Carbon Thin Films", Journal of the Vacuum Soc. of Japan, vol. 26, No. 1, 1983; pp. 22–29 (with English Abstract on p. 22).

A. Gehan, et al. "Nitrogen Containing Hydrogenated Amorphous Carbon for Thin–film Field Emission Cathodes", Appl. Phys. Lett 68(18), Apr. 29, 1996, pp. 2529–2531.

E. Joon Chi, et al., "Effects of Heat Treatment On the Field Emission Property of Amorphous Carbon Nitride", J. Vac. Sci. Technolg. B 16(3), May/Jun. 1998, pp. 1219–1221.

A Weber et al., "Carbon Based Thin Film Cathodes For Field Emission Displays", J. Vac. Sci. Technol. a 16(3), May/Jun. 1998; pp. 919–921.

M.W. Geis et al., "Electron Field Emission from Diamond and other Carbon Materials after $H_2$, $O_2$, and Cs Treatment," Appl. Phys. Lett. 67(9), 2B Aug. 1995, pp. 1328–1330.

K. Okano, et al., "Low–threshold Cold Cathodes Made of Nitorgen–doped Chemical–Vapour–Deposited diamond", Nature, vol. 381, May 9, 1996, pp. 140–141.

* cited by examiner

ELECTRON-EMITTING DEVICE, ELECTRON SOURCE, AND IMAGE-FORMING APPARATUS

BACKGROUND OF THE INVENTION

1. Field of the Invention

The present invention relates to an electron-emitting device, an electron source using the electron-emitting devices, an image-forming apparatus, such as display devices or the like, constructed using the electron source, and methods for producing them.

2. Related Background Art

The conventionally known electron-emitting devices are roughly classified under two types; thermionic cathodes and cold cathodes. The cold cathodes include field emission type (hereinafter referred to as "FE type") electron-emitting devices, metal/insulator/metal type (hereinafter referred to as "MIM type") electron-emitting devices, surface conduction type electron-emitting devices, and so on.

Examples of the known FE type devices include those disclosed in the following: W. P. Dyke & W. W. Dolan, "Field emission," Advance in Electron Physics, 8, 89 (1956); C. A. Spindt, "Physical Properties of thin-film field emission cathodes with molybdenum cones," J. Appl. Phys., 47, 5248 (1976); M. W. Geis, "Electron field emission from diamond and other carbon materials after $H_2$, $O_2$, and Cs treatment" Appl. Phys. Lett. 67 (9) (1995); W096/35640; Ken Okano, "Low-threshold cold cathodes made of nitrogen-doped chemical-vapor-deposited diamond," Nature, Vol. 381, 1996; A. J. Amaratunga, "Nitrogen containing hydrogenated amorphous carbon for thin-film field emission cathodes," Appl. Phys. Lett., 68 (18) (1996); A. Weber, "Carbon based thin film cathodes for field emission displays," J. Vac. Sci. Technol. A16 (3) (1998); Eung Joon Chi, "Effects of heat treatment on the field emission property of amorphous carbon nitride," J. Vac. Sci. Technol. B16 (3) (1998), and so on.

Examples of the known MIM type devices include those disclosed in C. A. Mead, "Operation of Tunnel-Emission Devices," J. Appl. Phys., 32, 646 (1961), and so on.

Examples of the surface conduction electron-emitting devices include those disclosed in M. I. Elinson, Radio Eng. Electron Phys., 10, 1290 (1965), and so on.

The surface conduction electron-emitting devices utilize such a phenomenon that electron emission occurs when electric current is allowed to flow in parallel to the surface in a thin film of a small area formed on a substrate. Examples of the surface conduction electron-emitting devices reported heretofore include those using a thin film of $SnO_2$ by Elinson cited above and others, those using a thin film of Au (G. Ditmmer: "Thin Solid Films," 9, 317 (1972)), those using a thin film of $In_2O_3/SnO_2$ (M. Hartwell and C. G. Fonstad: "IEEE Trans. ED Conf.," 519, (1975)), those using a thin film of carbon (Hisashi Araki et al.: Shinku (Vacuum), Vol. 26, No. 1, p22 (1983)), and so on.

A typical device configuration of these surface conduction electron-emitting devices is the device structure of M. Hartwell cited above, which is shown in FIG. 18. In the same drawing, numeral 1 designates an electrically insulative substrate. Numeral 4 denotes an electrically conductive film, which is, for example, a thin film of a metal oxide formed in an H-shaped pattern and in which an electron-emitting region 5 is formed by an energization operation called "forming" described hereinafter. In the drawing the gap L' is set to 0.5 to 1 mm and the width W' to 0.1 mm.

In these surface conduction electron-emitting devices, it was common practice to preliminarily subject the conductive film 4 to the energization operation called the forming, thereby forming the electron-emitting region 5. Namely, the forming is an operation for applying a dc voltage or a very slowly increasing voltage, for example at the increasing rate of about 1 V/min, to the both ends of the conductive film 4 to locally break, deform, or modify the conductive film, thereby forming the electron-emitting region 5 in an electrically higher resistance state than the resistance in the surroundings. In the electron-emitting region 5 a fissure is created in part of the conductive film 4 and electrons are emitted from near the fissure.

In the surface conduction electron-emitting device after the aforementioned forming operation, electrons are emitted from the above-stated electron-emitting region 5 when the current flows in the device with application of the voltage to the conductive film 4 including the electron-emitting region 5.

On the other hand, for example, as disclosed in Japanese Patent No. 2,836,015, No. 2,903,295, etc., the device after the forming is sometimes subjected to a treatment called an activation operation. The activation operation is a step by which remarkable change appears in the device current If and in the emission current Ie.

The activation step can be performed by repeatedly applying pulse voltage to the device, as in the case of the forming operation, under an ambience containing an organic substance. This operation causes a film mainly containing carbon or a carbon compound to be deposited from the organic substance existing in the ambience onto the electron-emitting region of the device and the vicinity thereof, so as to induce outstanding change in the device current If and in the emission current Ie, thereby achieving better electron emission characteristics.

FIGS. 20A and 20B are schematic diagrams to show the electron-emitting device disclosed in the above publications. In FIGS. 20A and 20B, reference numeral 1 designates an electrically insulating substrate, 2 and 3 electrodes, 4 the aforementioned electrically conductive film, 10 the film mainly containing carbon or the carbon compound, formed by the aforementioned activation operation, and 5 the electron-emitting region.

Since the surface conduction electron-emitting device described above is simple in the structure and easy in the production, it has the advantage of capability of forming an array of many devices across a large area. A variety of applications have been investigated heretofore in order to take advantage of this property. For example, such applications include charged beam sources, display devices, and so on.

An example of the application wherein a lot of surface conduction electron-emitting devices are arrayed is an electron source in which the surface conduction electron-emitting devices are arrayed in parallel and a lot of rows are arranged, each row including the surface conduction electron-emitting devices whose two terminals are connected to respective wires (for example, Japanese Patent Application Laid-Open No. 64-31332, No. 1-283749, and No. 2-257552).

Particularly, in the field of the image-forming apparatus such as the display devices and the like, flat panel display devices using liquid crystals are becoming widespread in recent years, in place of the CRTs, but they are not of a self-emission type. Therefore, they had the problem that a back light or the like was required, for example. Therefore, there were desires for development of the display device of the self-emission type.

When the image-forming apparatus is constructed as a display device in which an electron source comprised of a lot of surface conduction electron-emitting devices is combined with a fluorescent material for emitting visible light with reception of electrons emitted from the electron source, the apparatus, even of the large area, can be produced relatively readily and is the emissive display with excellent quality of display.

SUMMARY OF THE INVENTION

An object of the present invention is to provide a configuration of the surface conduction electron-emitting device capable of realizing highly efficient and stable electron emission characteristics, an electron source and an image-forming apparatus using it, and methods for producing them.

The inventors have been conducted intensive and extensive research in order to solve the above object and came to accomplish the present invention, based on such knowledge that the electron emission efficiency of the surface conduction electron-emitting device varied large, depending upon the quality of the carbon-containing film (carbon film), particularly, depending upon whether the carbon film present on the applied side of the higher potential during the driving contains nitrogen.

Specifically, an electron-emitting device of the present invention is an electron-emitting device comprising first and second carbon films laid on a substrate, and first and second electrodes electrically connected to the respective carbon films, wherein a higher voltage is applied to the second electrode than to the first electrode and wherein the carbon film connected to the second electrode comprises nitrogen.

Another electron-emitting device of the present invention is an electron-emitting device comprising a carbon film and first and second electrodes electrically connected to two ends of the carbon film, wherein the carbon film comprises a gap located between the first and second electrodes and wherein a ratio of nitrogen atoms in the carbon film to carbon atoms in the carbon film is not less than 2/100 and not more than 15/100.

When the carbon-containing film (carbon film) comprises nitrogen, resulting physical properties are an increase of electron scattering coefficient and an increase of secondary emission coefficient of the carbon-containing film (carbon film). For this reason, the aforementioned electron emission efficiency can be increased when the carbon film connected to the electrode to which the higher voltage is applied during the driving (the carbon film where electrons are scattered) is made to contain nitrogen. Namely, with the electron-emitting device of the present invention, the device current If can be decreased, while the emission current Ie is increased.

However, the thermal stability and electric conductivity will be degraded with increase of the nitrogen content on the other hand.

For this reason, the electron-emitting device can be realized with high efficiency and excellent driving stability by controlling the ratio of nitrogen atoms to carbon atoms in the carbon-containing film (carbon film) (the number of nitrogen atoms/the number of carbon atoms) to not less than 2/100 and not more than 15/100.

Further, when the ratio of nitrogen atoms to carbon atoms in the carbon-containing film (carbon film) (the number of nitrogen atoms/the number of carbon atoms) is controlled to larger than 5/100 and not more than 15/100, the electron-emitting device can be realized with extremely high efficiency and excellent driving stability.

An electron source of the present invention is an electron source for emitting electrons according to an input signal, wherein a plurality of electron-emitting devices of the present invention described above are arrayed on a substrate; the electron source is arranged preferably in a configuration in which there are a plurality of rows of electron-emitting devices whose two terminals are connected to respective wires in each row and in which there is modulation means, or in a configuration in which a plurality of electron-emitting devices are connected in a matrix to a plurality of X-directional wires and Y-directional wires electrically insulated from each other.

The present invention also provides an image-forming apparatus comprising an electron source and an image-forming member and adapted to form an image according to an input signal, wherein the electron source is the electron source of the present invention described above.

DETAILED DESCRIPTION OF THE PREFERRED EMBODIMENTS

Figure 4:
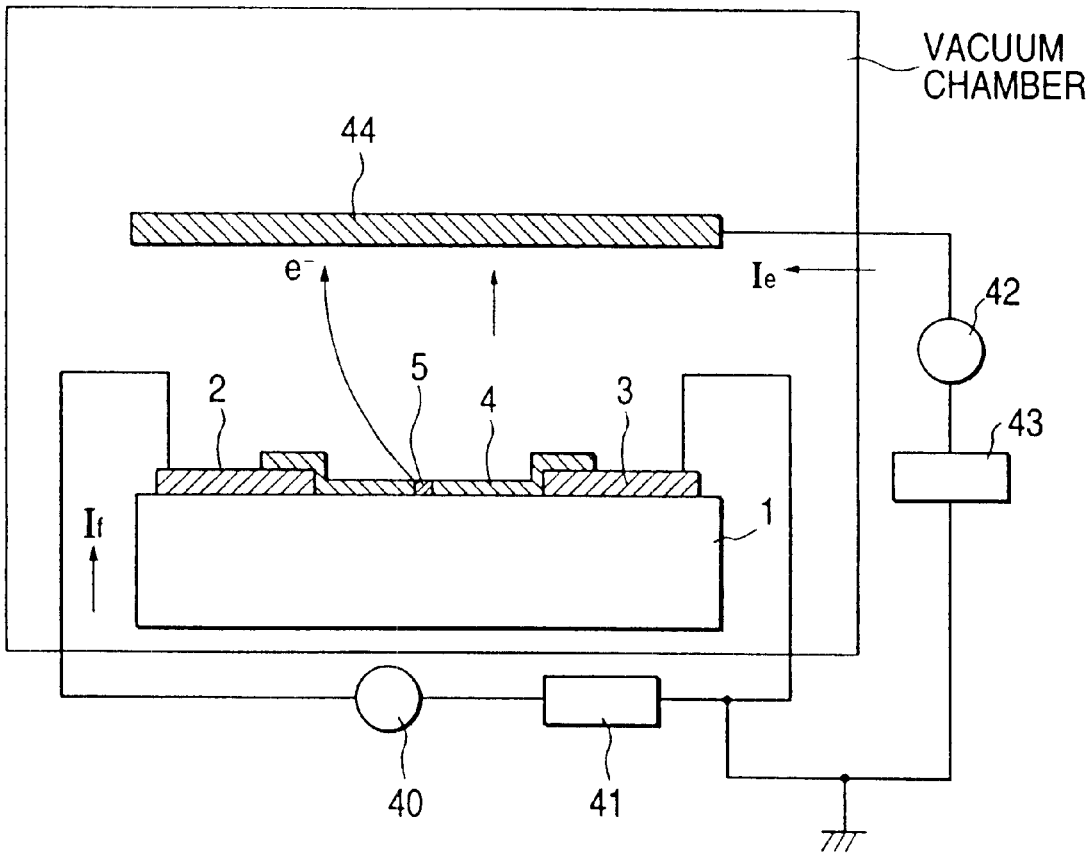
FIG. 4 is a schematic structural diagram to show an example of a measurement and evaluation system which can be used for production of the electron-emitting device of the present invention.
Figure 20A:
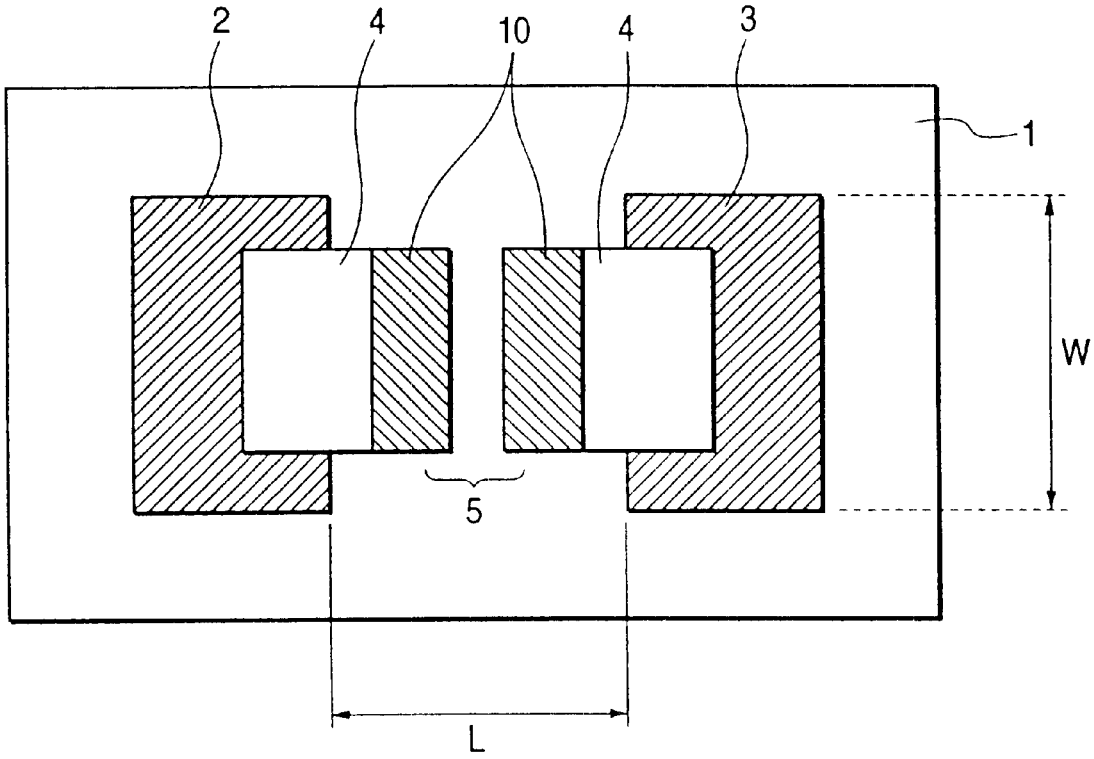
FIG. 20A PRIOR ART
FIG. 20A and FIG. 20B are schematic diagrams of the surface conduction electron-emitting device of the prior art example.
Figure 20B:
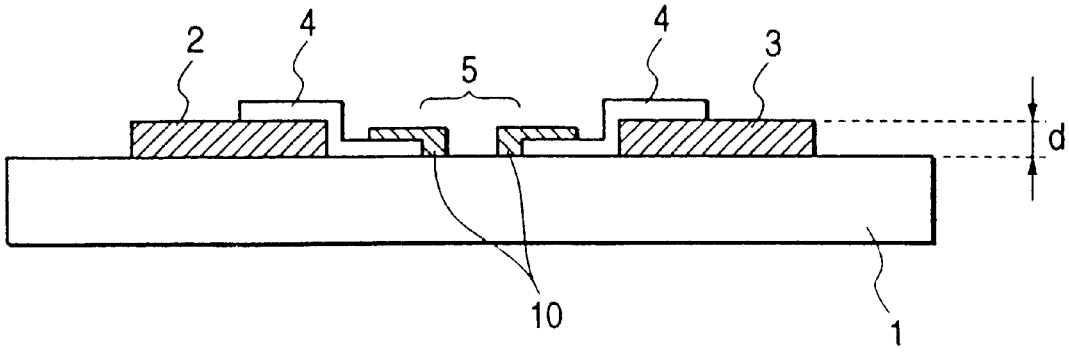
FIG. 20B PRIOR ART

The electron-emitting device illustrated in FIGS. 20A and 20B is basically driven in a vessel maintained under a vacuum inside, as illustrated in FIG. 4. On that occasion, one electrode (for example, the electrode 2) is set at a higher potential than the other electrode (for example, the electrode 3), whereby electrons are emitted from the electron-emitting region 5 toward anode electrode 44.

Figure 19:
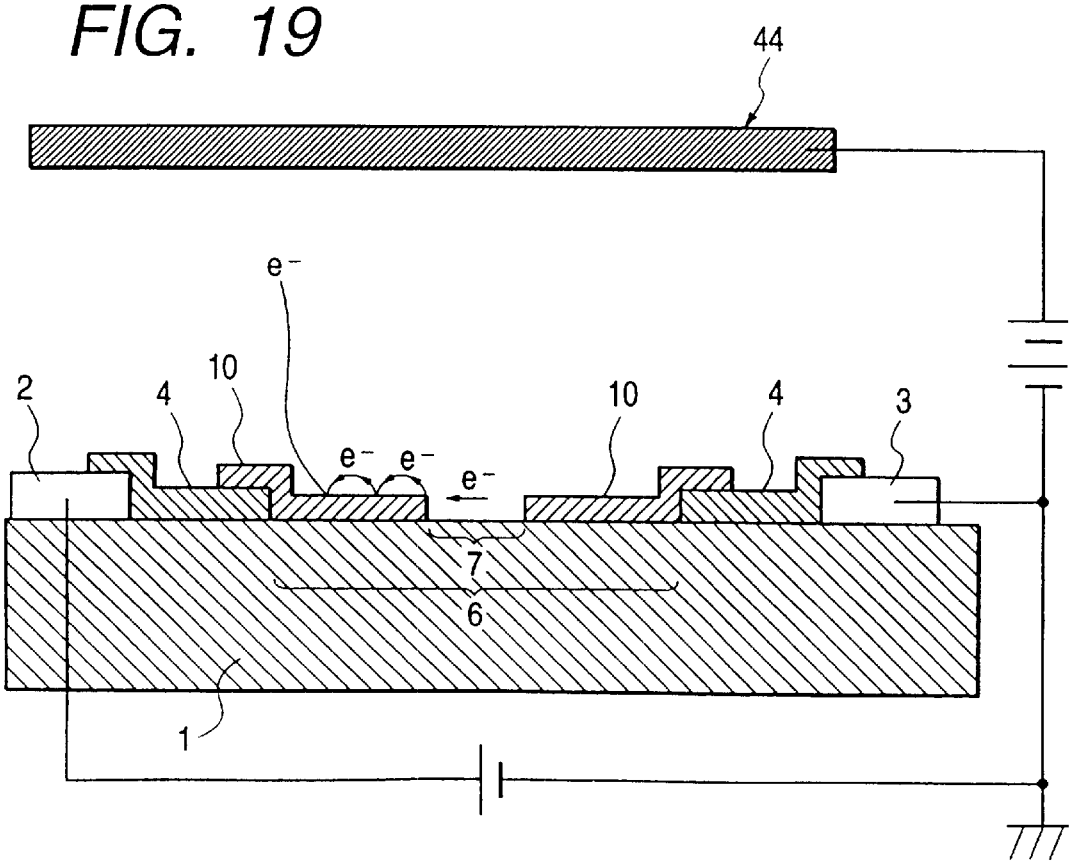
FIG. 19 is a schematic diagram for explaining the electron emission mechanism of the surface conduction electron-emitting device.

The mechanism of electron emission from the electron-emitting region 5 will be described referring to the schematic diagram of FIG. 19. First, an appropriate voltage is applied to the electrode 2 and/or to the electrode 3 so that the electrode 2 is kept at a higher potential than the electrode 3, as described above. As a result, a potential difference is created in the gap 7 between the opposite films 10 containing the principal component of carbon or the carbon compound (hereinafter referred to "carbon films"). It is thought that this potential difference thus created causes electrons to tunnel from the edge of the carbon film 10 (the right side in FIG. 19) on the lower potential side (the side of the electrode 3) to the edge of the carbon film 10 (the left side in FIG. 19) on the higher potential side (the side of the electrode 2), which are opposed to each other. Further, it is considered that the electrons tunneling from the carbon film 10 at the lower potential (on the side of the electrode 3) are scattered by the carbon film 10 at the higher potential (on the side of the electrode 2) and that electrons jumping out of a predetermined range (distance) after repetitions of scattering mostly reach the anode electrode 44.

In the above process of scattering the most of the electrons tunneling from the edge of the carbon film 10 (the right side in FIG. 19) at the lower potential (on the side of the electrode 3) are absorbed by the carbon film 10 (the left side in FIG. 19) at the higher potential (on the side of the electrode 2), to become ineffective current (device current If) flowing between the electrode 2 and the electrode 3.

Therefore, in the case of the surface conduction electron-emitting device obtained through the above-stated activation step, though the emission current Ie and the device current If are increased, the electron emission performance is not always realized with as high efficiency as sufficiently satisfactory.

The efficiency stated herein means a current ratio of emission current Ie to device current If. Namely, it is desirable that the device current If be as small as possible, while the emission current Ie be as large as possible.

Thus the surface conduction electron-emitting devices used in the electron sources, the image-forming apparatus, etc. are required to gain the sufficient emission current against practical voltage (10 V to 20 V), show no great variation in the emission current Ie and the device current If during driving, and resist deterioration of the emission current Ie and the device current If over a long period.

If the highly efficient electron emission-property can be stably controlled over a long period, for example, in the case of the image-forming apparatus incorporating the fluorescent material as an image-forming member, it is possible to realize a bright and high-quality image-forming apparatus with low power consumption, for example, a flat panel television display.

Preferred embodiments of the present invention will be described below.

First explained is the basic structure of the electron-emitting device according to the present invention.

Figure 1A:
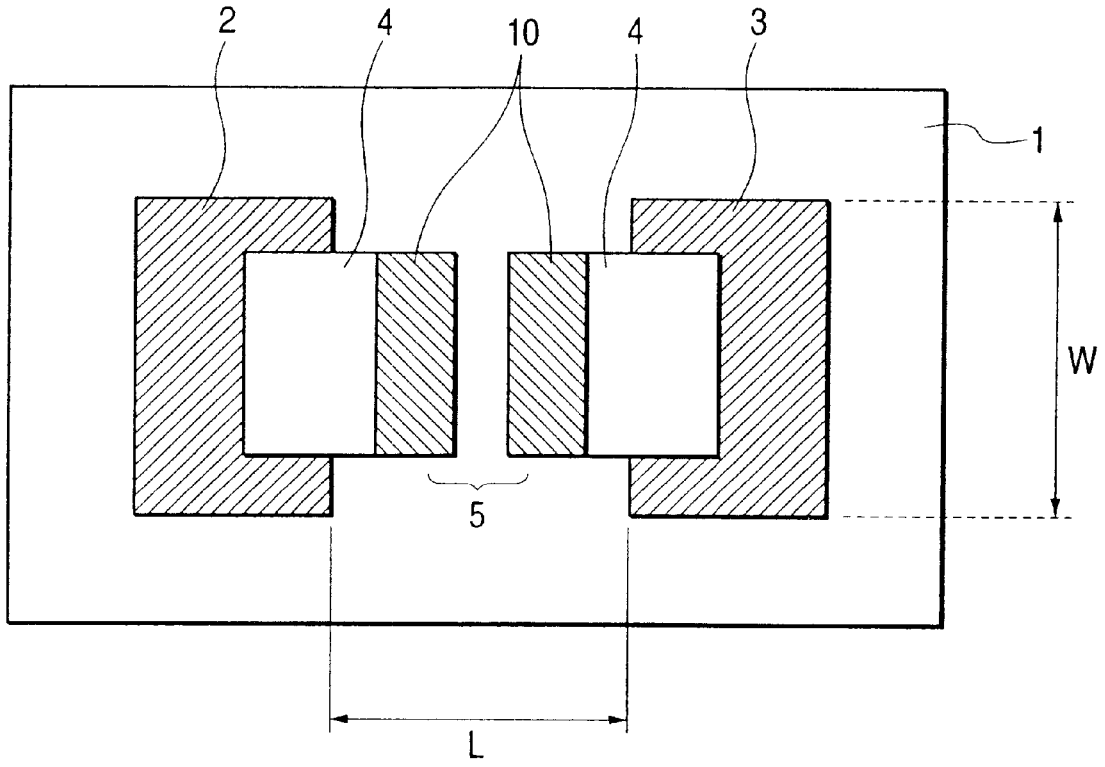
FIG. 1A and FIG. 1B are schematic diagrams to show a fundamental example of the structure of the surface conduction electron-emitting device according to the present invention.
Figure 1B:
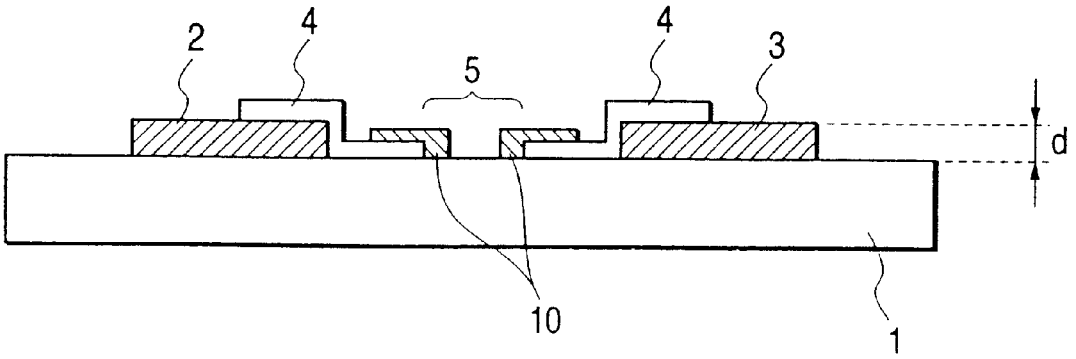

FIGS. 1A and 1B are a schematic plan view and a schematic sectional view, respectively, to show the basic structure of a plane type electron-emitting device according to the present invention. The basic structure of the electron-emitting device according to the present invention will be described referring to FIGS. 1A and 1B.

In FIGS. 1A and 1B, numeral 1 designates the substrate, 2 and 3 the electrodes (device electrodes), 4 the electrically conductive films, 5 the electron-emitting region, and 10 the films containing carbon (carbon-containing films).

This electron-emitting device is driven in the device maintained in a depressurized state inside, as illustrated in FIG. 4. In FIG. 4, numeral 1 represents the substrate, 2 and 3 the device electrodes, 4 the conductive films, and 5 the electron-emitting region. Numeral 41 indicates a power supply for applying the device voltage Vf to the electron-emitting device, 40 a current meter for measuring the device current If flowing in the conductive films 4 between the device electrodes 2, 3, 44 an anode electrode for capturing the emission current Ie emitted from the electron-emitting region 5 of the device, 43 a high-voltage supply for applying the voltage to the anode electrode 44, and 42 a current meter for measuring the emission current Ie emitted from the electron-emitting region 5 of the device.

As illustrated in FIG. 4, the higher voltage is applied to the electrode 2 than to the electrode 3 and a much higher voltage is applied to the anode electrode 44, whereupon the electron-emitting region emits electrons toward the anode electrode.

In the electron-emitting device of the present invention, the carbon-containing film connected to the electrode kept at the higher potential (the electrode 2 in the case of FIG. 4) contains nitrogen.

When the carbon-containing film (carbon film) connected to the higher-potential electrode contains nitrogen at the ratio of nitrogen atoms to carbon atoms present in the carbon film (the number of nitrogen atoms/the number of carbon atoms) not less than 2/100, as described above, the electron emission efficiency starts to increase remarkably. This is conceivably because the resulting physical properties involved the increase of electron scattering efficiency and the increase of secondary emission efficiency of the carbon-containing film. Therefore, in the case of the device of the present invention, part of the electrons that became the device current If flowing between the device electrodes are changed into the emission current Ie, thereby increasing the electron emission efficiency as a result.

However, the thermal stability and electric conductivity will be degraded with increase of the nitrogen content. For forming the electron-emitting device with high efficiency and excellent driving stability within a practical range, therefore, the upper limit of the ratio of nitrogen atoms to carbon atoms present in the carbon-containing film (carbon film) connected to the higher-potential electrode (the number of nitrogen atoms/the number of carbon atoms) is 15/100.

When the ratio of nitrogen atoms to carbon atoms present in the carbon-containing film (carbon film) connected to the electrode kept at the higher potential (the electrode 2 in the case of FIG. 4) (the number of nitrogen atoms/the number of carbon atoms) is controlled to not less than 2/100 and not more than 15/100, the electron-emitting device can be realized with extremely high efficiency and excellent driving stability accordingly.

The substrate 1 is one selected from glass substrates, such as those of quartz glass, glass with a reduced impurity content of Na or the like, soda lime glass, $SiO_2$ coated glass, and so on.

A material for the opposed device electrodes 2, 3 can be any material that has the electrically conductive nature, but the material can be selected, for example, from metals such as Ni, Cr, Au, Mo, W, Pt, Ti, Al, Cu, and Pd, or alloys thereof; print conductors comprised of a metal or a metal oxide such as Pd, Ag, Au, $RuO_2$, or Pd-Ag, and glass, etc.; transparent, conductive materials such as $In_2O_3$–$SnO_2$ and the like; semiconductor materials such as polysilicon and the like; and so on.

The device electrode gap L, the length W of the device electrodes, and the shape thereof are properly designed according to an application form of this device etc. For example, in the case of a display device for television or the like described hereinafter, the pixel size is designed corresponding to the image size. Particularly, a high-definition television monitors necessitate small pixel size and high definition. In order to achieve sufficient luminance in the limited size of the electron-emitting devices, they are designed so as to gain the sufficient emission current.

The device electrode gap L is in the range of several ten nm to several hundred $\mu$m, and is set according to the photolithography technology being the basis of the production method of the device electrodes, i.e., the performance of exposure apparatus, an etching method, etc., the voltage applied between the device electrodes, and so on. The gap L is preferably in the range of several pm to several ten $\mu$m.

The device electrode length W and the film thickness d of the device electrodes 2, 3 are properly designed depending upon the resistance of the electrodes, the aforementioned connection to wiring, and the matter concerning placement of the electron source with many electron-emitting devices provided; normally, the length W of the device electrodes is in the range of several $\mu$m to several hundred $\mu$m and the film thickness d of the device electrodes is in the range of several nm to several $\mu$m.

Although FIGS. 1A and 1B show the conductive films 4 formed between the opposed device electrodes 2 and 3 and on the device electrodes 2, 3 provided on the substrate 1, there are also cases in which the conductive films are not formed on the device electrodes 2, 3. Namely, it is possible to employ such a stack configuration that the conductive films 4 and the opposed device electrodes 2, 3 are stacked in the stated order on the substrate 1.

The conductive films 4 are a pair of conductive, thin films opposed to each other with a second gap 6 formed in between by the forming operation or the like (see FIG. 3C), which will be detailed hereinafter. Although the figures schematically show the conductive films 4 in a completely separated state at the border of the second gap 6 opposite to each other in the lateral direction to the surface of the substrate, there are also cases in which the conductive films 4 are connected in part. In other words, it can be mentioned as a form in which the second gap 6 is formed in part of the conductive film 4 which electrically connects a pair of electrodes to each other. Namely, the conductive films are ideally separated completely from each other, but the pair of conductive films may also be connected in a small area as long as they can demonstrate the sufficient electron emission characteristics.

The conductive films 4 are preferably fine particle films comprised of fine particles in order to achieve the good electron emission characteristics. The thickness of the films 4 is properly set taking account of the step coverage over the device electrodes 2, 3, the resistance between the device electrodes 2, 3, the forming conditions described hereinafter, and so on.

Since the magnitude of the device current If and the emission current Ie depends upon the width W' of the conductive films 4, the conductive films are designed so as to obtain the sufficient emission current in the limited size of the electron-emitting device, as in the case of the shape of the device electrodes described above.

In general, the thermal stability of the conductive films 4 is an important parameter that dominates the lifetime of the electron emission characteristics and, therefore, a material having a higher melting point is desirably used as a material for the conductive films 4. However, the higher the melting point of the conductive films 4, the more power the energization forming described hereinafter necessitates, normally.

Further, depending upon the form of the resultant electron-emitting region, there could arise a problem in the electron emission characteristics, for example, such as increase in the applied voltage enough for electron emission (threshold voltage) or the like, in some cases.

The present invention does not require a material having a particularly high melting point as a material for the conductive films 4, and thus permits us to select a material and a form capable of forming a good electron-emitting region by relatively low forming power.

Examples of preferred materials satisfying the above conditions are electroconductive materials such as Ni, Au, PdO, Pd, Pt, and so on having such a thickness that Rs (sheet resistance) is in the range of $10^2$ to $10^7$ $\Omega/\square$. Rs is a value appearing in an equation of R=Rs (1/w) where the resistance R is measured in the longitudinal direction of a thin film having the thickness t, the width w, and the length 1, and thus $Rs=\rho/t$ where $\rho$ is the resistivity. The thickness to indicate the above resistance is in the range of approximately 5 nm to 50 nm. In this thickness range, the thin film of each material has the form of fine particle film.

The fine particle film stated herein is a film as an assemblage of plural fine particles and the microstructure thereof is a state in which the fine particles are dispersed separately or a state in which the fine particles are adjacent to each other or overlapping each other (including a state in which some fine particles gather to form the island-shaped structure as a whole).

The grain sizes of the fine particles are in the range of several hundred pm to several hundred nm, and are preferably in the range of 1 nm to 20 nm.

Further, among the materials exemplified above, PdO is a suitable material, because a thin film of PdO can be formed readily by baking an Pd organic compound in the atmosphere, because it is a semiconductor having a relatively low electric conductivity and a wide process margin of thickness for obtaining the resistance Rs in the aforementioned range, because the film resistance can be lowered by readily reducing the films to the metal Pd after formation of the electron-emitting region of high resistance in the conductive film by the forming operation detailed later, and so on. It is, however, noted that the effect of the present invention can also be achieved by the other materials without having to be limited to PdO nor to the above exemplified materials.

The length of the electron-emitting region 5 is almost determined by the width W' of the conductive films 4.

The electron-emitting region 5 is comprised of the second gap 6 formed in part of the conductive film 4 and the carbon-containing films 10 formed so as to cover the substrate in the second gap and the conductive films near the gap 6, as illustrated in FIGS. 1A and 1B.

The figures schematically show the carbon films 10 opposed to each other in the lateral direction to the surface of the substrate and completely separated from each other on either side of the first gap 7, but there are also cases in which the carbon films 10 are connected in part. In other words, it can also be mentioned as a form in which the first gap 7 is formed in part of the carbon film which electrically connects the pair of electrodes to each other. Namely, the carbon films are ideally separated from each other completely, but the pair of carbon films may also be connected in a small region as long as they can demonstrate the sufficient electron emission characteristics.

The carbon-containing films 10 can also be formed so as to cover the device electrodes 2, 3, depending upon the device electrode gap (L), the activation conditions described hereinafter, etc., and, further, the films 10 can also be formed so as to be connected directly to the electrodes 2, 3 without use of the conductive films 4. Namely, the point is that electric connection is made at least between the carbon films (10) and the electrodes (2, 3) placed on the surface of the substrate. Since the conductive films 4 are the very thin films, they are apt to undergo thermal structural change and composition change, such as cohesion or the like, due to the heat or the like during the production process or during the driving, the details of which will be described hereinafter. For that reason, where the conductive films are used in the present invention, the carbon films 10 are laid so as to cover the surfaces of the conductive films. When the conductive films are not used, the clearance between the device electrodes corresponds to the aforementioned second gap.

FIGS. 1A and 1B show the structure in which the carbon films 10 are separated left and right and opposed to each other on either side of the first gap 7, but there are also cases in which the carbon films 10 are connected in part of the first gap 7.

It is found that the carbon films 10 function as part of the conductive films 4 and dominate the electron emission characteristics, as the substance constituting the electron-emitting region 5.

In the production methods of the present invention, the electron emission characteristics are controlled by controlling the nitrogen content in the carbon films 10 in a nitrogen introducing step described hereinafter. Specifically, the nitrogen content in the carbon films 10 placed opposite to each other can be controlled by a plasma process, for example, in an ambience of nitrogen alone or in an ambience of mixed gas of nitrogen and inert gas.

The carbon films are made mainly of graphite-like carbon. Therefore, they have sufficient electric conduction and stability under a strong electric field. However, if they contain an excessive amount of nitrogen they will have the semiconductive property and the electric conductive property thereof will be too low. Therefore, there is an appropriate range of the nitrogen content. Since the carbon films become thermally instable at high nitrogen contents, the appropriate range is also specified in this respect.

According to the results of extensive and intensive research by the inventors, it is preferable that the ratio of nitrogen atoms to carbon atoms present in the carbon film connected to the electrode kept at the higher potential (the electrode 2 in the case of FIG. 4) (the number of nitrogen atoms/the number of carbon atoms) be not less than 2/100 and not more than 15/100. Further, it is particularly preferable that the above number of nitrogen atoms/the number of carbon atoms be greater than 5/100 and not more than 15/100. If the nitrogen content is less than 5/100, it will not be easy to obtain the sufficiently satisfactory electron emission efficiency, though the stability is excellent. On the other hand, if the nitrogen content is over 15/100, the problem of stability will become easier to arise and the electron emission efficiency will also tend to decrease. Composition ratios of nitrogen to carbon in the carbon films, i.e., ratios of N/C atoms, can be obtained, for example, by X-ray photoelectron spectroscopy (XPS or ESCA, which will be abbreviated as XPS). An XPS analysis system commercially available can be used for the XPS analysis.

The method for measuring the ratios of N/C atoms in the carbon films by the above XPS analysis is carried out, for example, according to the following procedures.

First, the carbon film in the electron-emitting device of the present invention is placed at the center of the optical axis of the spectroscope. In this state, the lens of the photoelectron detection system may be stopped down to an analyzed area of a constant region (specifically, to the diameter of about 100 $\mu$m) to effect the analysis, but the analysis is carried out preferably in a state in which the spot of radiated X-rays is focused in the diameter of about several ten $\mu$m or in a state in which a photoelectron capturing region is narrowed to the diameter of about several ten $\mu$m by an aperture.

Then the above ratio of N/C atoms can be computed from intensities (normally, areas) of the C1s peak and the N1s peak appearing in a resultant X-ray photoelectron spectrum, sensitivities of them, and so on.

Next described is a step type surface conduction electron-emitting device which is another structure of the surface conduction electron-emitting device according to the present invention.

Figure 2:
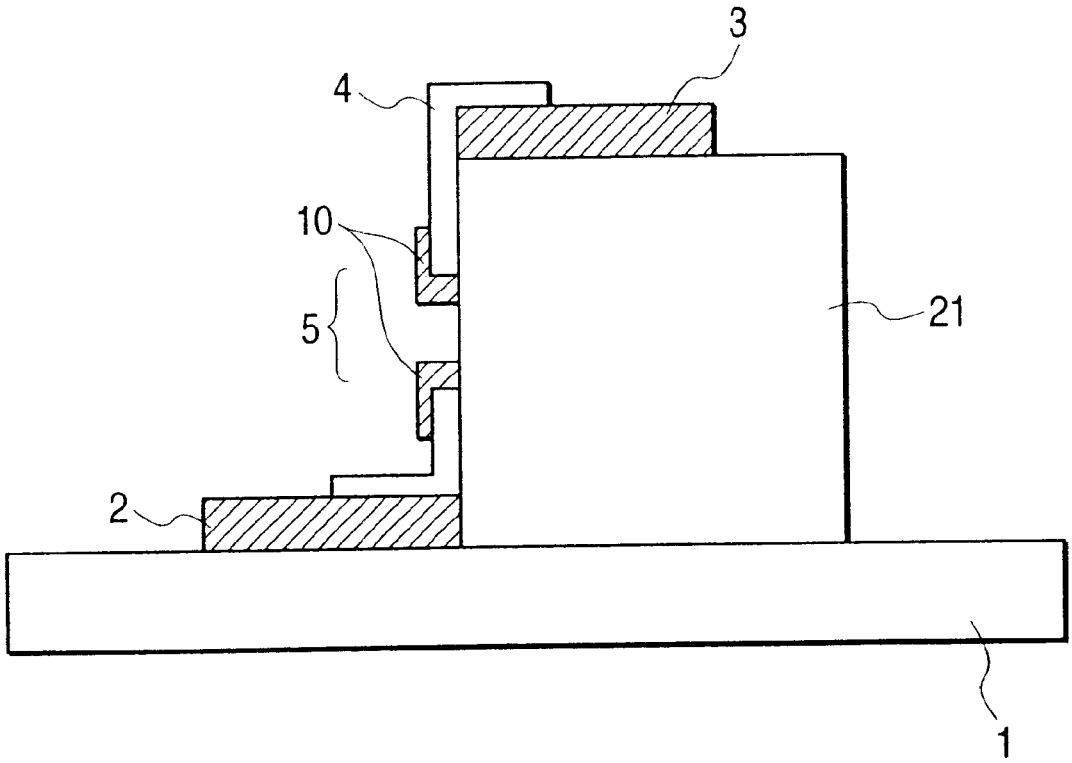
FIG. 2 is a schematic diagram to show another fundamental example of the structure of the surface conduction electron-emitting device according to the present invention.

FIG. 2 is a schematic diagram to show the basic structure of the step type surface conduction electron-emitting device. In FIG. 2, like portions are designated by identical reference symbols as in FIGS. 1A and 1B.

The substrate 1, device electrodes 2, 3, conductive films 4, electron-emitting region 5, and carbon-containing films 10 are those made of the same materials as those of the plane type surface conduction electron-emitting device described above.

Numeral 21 denotes a step-forming portion. The step-forming portion 21 is made of an electrically insulating material such as $SiO_2$ or the like by the vacuum evaporation process, the printing method, the sputtering method, or the like. The film thickness of the step-forming portion 21 corresponds to the device electrode gap L of the plane type surface conduction electron-emitting device described previously, which is several ten nm to several ten μm. The thickness of the step-forming portion 21 is set depending upon the production method of the step-forming portion, the voltage applied between the device electrodes, etc., and it is preferably in the range of several ten nm to several μm.

Since the conductive films 4 are formed after the formation of the device electrodes 2, 3 and the step-forming portion 21, the conductive films 4 are deposited on the device electrodes 2, 3. The electron-emitting region 5 is illustrated in a straight line shape on the side surface of the step-forming portion 21 in FIG. 2, but the shape and position thereof may be determined depending upon the production conditions, the energization forming conditions described hereinafter, etc., without having to be limited to this example.

FIGS. 3A to 3D schematically show an example of the method for producing the electron-emitting device according to the present invention. The production method of the present invention will be described in order referring to FIGS. 1A and 1B and FIGS. 3A to 3D.

Figure 3A:
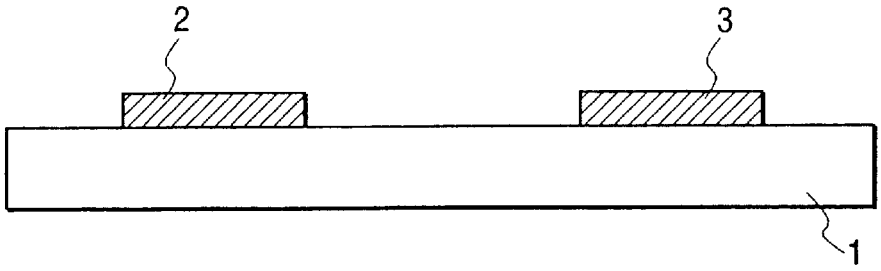
FIG. 3A, FIG. 3B, FIG. 3C, and FIG. 3D are diagrams for explaining a method for producing the electron-emitting device of the present invention.

1) The substrate 1 is cleaned well with a detergent, pure water, and an organic solvent, and dried. Thereafter, the material of device electrodes is deposited by vacuum evaporation, sputtering, or the like and then the device electrodes 2, 3 are formed by photolithography (FIG. 3A).

In the case wherein the carbon-containing films (carbon films) 10 are formed on and between the electrodes 2, 3 without use of the conductive film 4 as described previously, the gap between the electrodes 2, 3 can be set, for example, by use of the FIB process or the like so as to be approximately equal to the second gap 6 formed in the forming step described hereinafter. In that case, the following steps 2) and 3) can be omitted. It is, however, preferable to use the above conductive film 4 in order to produce the device of the present invention at low cost.

Figure 3B:
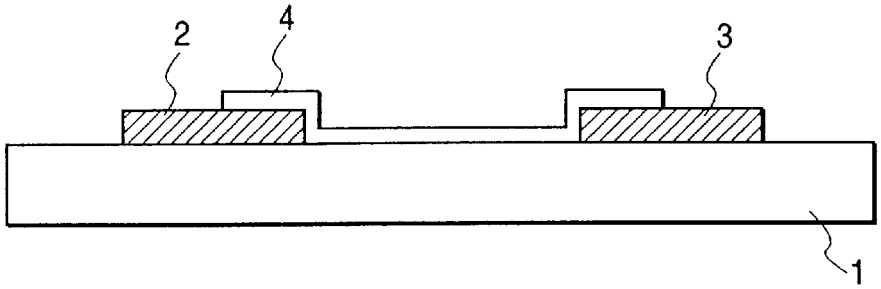

2) Between the device electrode 2 and the device electrode 3 provided on the substrate 1, an organometallic solution is applied and dried to form an organometallic film. The organometallic solution is a solution of an organometallic compound containing the principal element of the aforementioned metal such as Pd, Ni, Au, Pt or the like. After this, the organometallic film is burned and patterned by lift-off, etching, or the like, thereby forming the conductive film 4 (FIG. 3B). The method of forming the conductive film 4 was described by the method of applying the organometallic solution herein, but, without having to be limited to this, the conductive film 4 may also be formed by vacuum evaporation, sputtering, CVD, dispersion application, dipping, a spin coating, an ink-jet printing method, and so on in some cases.

Figure 3C:
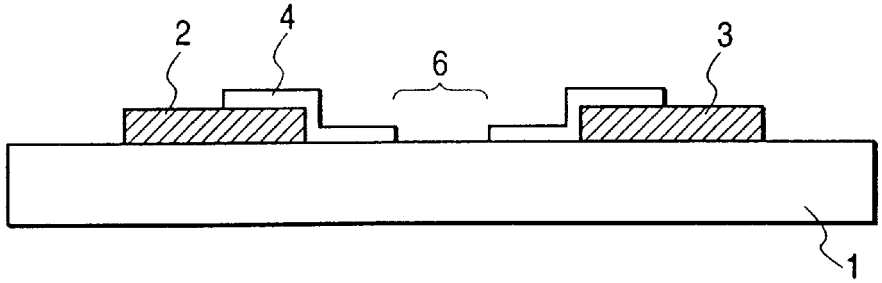

3) Then the energization operation called the forming is carried out by applying the pulsed voltage or increasing voltage from an unillustrated power supply between the device electrodes 2, 3, whereupon the second gap 6 is created in part of the conductive film 4 (FIG. 3C). In FIG. 3C, the conductive films 4 are opposed to each other in the separate state on the left and right sides of the gap 6, but there are also cases in which this pair of conductive films 4 are connected in part of the gap 6.

Electrical processing operations after the forming operation can be carried out in the measurement-evaluation apparatus illustrated in FIG. 4.

The measurement-evaluation apparatus will be described below.

FIG. 4 is a schematic, structural drawing of the measurement-evaluation apparatus for measuring the electron emission characteristics of the device having the structure shown in FIGS. 1A and 1B. In FIG. 4, numeral 1 represents the substrate, 2 and 3 the device electrodes, 4 the conductive films, and 5 the electron-emitting region. Numeral 41 indicates the power supply for applying the device voltage Vf to the electron-emitting device, 40 the current meter for measuring the device current If flowing in the conductive films 4 between the device electrodes 2, 3, 44 the anode electrode for capturing the emission current Ie emitted from the electron-emitting region of the device, 43 the high-voltage supply for applying the voltage to the anode electrode 44, and 42 the current meter for measuring the emission current Ie emitted from the electron-emitting region 5 of the device.

For measuring the above device current If and emission current Ie of the electron-emitting device, the power supply 41 and current meter 40 are connected to the device electrodes 2, 3, and the anode electrode 44 to which the power supply 43 and current meter 42 are connected is located above the electron-emitting device.

The electron-emitting device and anode electrode 44 are set in a vacuum chamber, and this vacuum chamber is equipped with devices necessary for the vacuum chamber, including an evacuation pump, a vacuum meter, etc., though not illustrated, so as to be able to measure and evaluate the electron-emitting device under a desired vacuum. The evacuation pump is comprised of a normal high vacuum system comprised of a turbo-pump and a rotary pump, or a high vacuum system such as a magnetic levitation turbo-pump, a dry pump, or the like not using oil, and an ultra-high vacuum system consisting of an ion pump. The entire vacuum chamber and the electron-emitting device can be heated by a heater not illustrated.

The forming operation is carried out by a method for applying pulses whose pulse peak values are a constant voltage or by a method for applying voltage pulses with increasing pulse peak values.

Figure 5A:
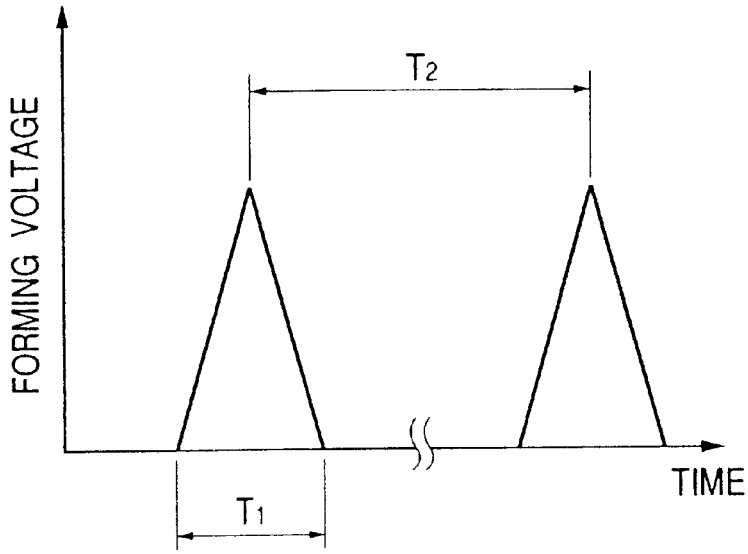
FIG. 5A and FIG. 5B are schematic diagrams to show examples of voltage waveforms in the energization forming operation, which can be adopted in the production of the electron-emitting device of the present invention.

FIG. 5A illustrates the voltage waveform where pulses with the pulse peak values of the constant voltage are applied. In FIG. 5A, T1 and T2 indicate the pulse width and pulse spacing of the voltage waveform, T1 being 1 μsec to 10 msec and T2 being 10 μsec to 100 msec, and the peak value of the triangular waves (the peak voltage upon the forming) is properly selected as occasion may demand. The pulses are applied under a vacuum ambience.

Figure 5B:
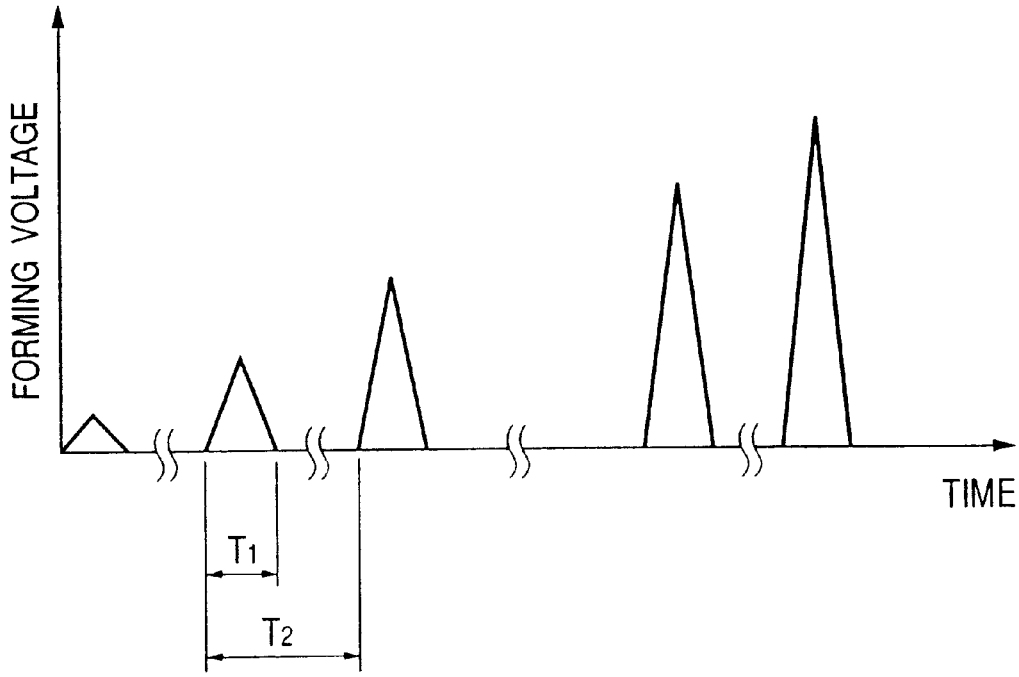

Next, FIG. 5B shows the voltage waveform where the voltage pulses are applied with increasing pulse peak values. In FIG. 5B, T1 and T2 indicate the pulse width and pulse spacing of the voltage waveform, T1 being 1 μsec to 10 msec and T2 being 10 μsec to 100 msec, and the peak values of the triangular waves (the peak voltages upon the forming) are increased, for example, in steps of about 0.1 V. The pulses are applied under a vacuum ambience.

The end of the forming operation is determined as follows. A voltage so low as not to locally break or deform the conductive film 4, for example the pulse voltage of about 0.1 V, is placed between the forming pulses to measure the device current, and the resistance is calculated. For example, when the resistance is 1800 times as great as a resistance value before the forming process, the forming is ended.

On the occasion of forming the gap 6 as described above, the forming operation is carried out by applying the triangular pulses between the electrodes of the device, but the waves applied between the electrodes of the device do not have to be limited to the triangular waves, and may be any other waves such as rectangular waves. In addition, the peak value, the pulse width, the pulse spacing, etc. of the waves are not limited to the above-stated values, either, but appropriate values can be selected according to the resistance etc. of the electron-emitting device so as to form the gap 6 well.

4) Then the activation operation is effected on the device after completion of the forming. The activation operation is performed by introducing gas of an organic substance into the vacuum chamber illustrated in FIG. 4 and applying the voltage between the electrodes of the device under an atmosphere containing the organic substance. This operation causes the carbon films 10 to be deposited on the substrate in the second gap 6 and on the conductive films 4 near the gap 6 from the organic substance present in the atmosphere. This results in remarkable change in the device current If and the emission current Ie (FIG. 3D).

The ambience containing the organic substance can be established, for example, by utilizing the organic gas remaining in the ambience after evacuation of the inside of a vacuum vessel by an oil diffusion pump or a rotary pump, or by sufficiently evacuating the inside once into a vacuum by an ion pump and introducing gas of an adequate organic substance into the vacuum. The preferred gas pressure of the organic substance at this time differs depending upon the aforementioned application form, the shape of the vacuum vessel, the kind of the organic substance, and so on, and is thus properly set depending upon the case.

The appropriate organic substance herein can be selected from aliphatic hydrocarbons represented by alkane, alkene, and alkyne, aromatic hydrocarbons, alcohols, aldehydes, ketones, organic acids such as phenol, carboxylic acid, and sulfonic acid, and so on. Specific examples of the organic substance include saturated hydrocarbons represented by $C_nH_{2n+2}$, such as methane, ethane, and propane, unsaturated hydrocarbons represented by the composition formula of $C_nH_{2n}$ or the like, such as ethylene and propylene, benzene, toluene, methanol, ethanol, formaldehyde, acetaldehyde, acetone, methyl ethyl ketone, phenol, formic acid, acetic acid, propionic acid, and so on.

Figure 3D:
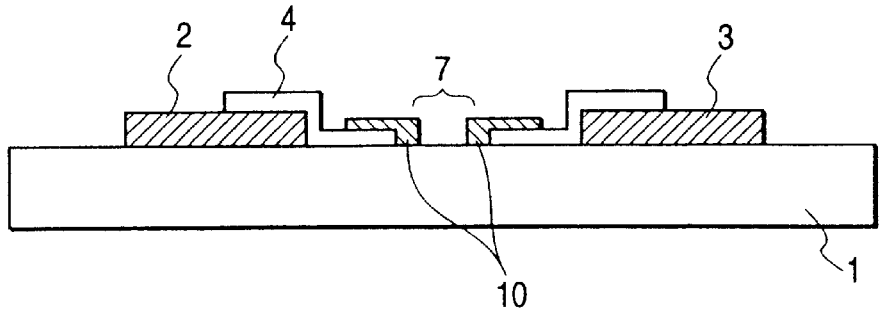

By the above activation step, as illustrated in FIG. 3D, the carbon films 10 are formed on the substrate in the second gap 6 and on the conductive films 4 near it. Although the carbon films are illustrated in the separate state on the left and right sides of the first gap 7 in FIG. 3D, there are also cases in which they are connected in part of the gap 7. The gap 7 being the first gap is narrower than the second gap 6 and is located in the second gap 6.

In the production method of the present invention, the step of introducing nitrogen into the carbon films, which were deposited on the device by the activation operation, is carried out after this activation operation step, and, in order to permit easy control of the nitrogen content in the carbon films on the occasion of the nitrogen introducing step, the organic substance containing neither nitrogen molecules nor nitrogen atoms is used in the activation operation of the present invention.

The end of the activation step can be properly determined while measuring the device current If and the emission current Ie.

The deposition mechanism of the carbon films in the electron-emitting device according to the present invention is not always clear yet. It can be considered, however, that the organic molecules are decomposed to bring about the deposition by complicated combination of energies such as heat, radiation of electron beam, electric field, light, and so on. The physical properties of the carbon films 10 deposited vary depending upon the control of applied pulses or depending upon the type of the organic molecules selected. Therefore, the physical properties (the conductivity, effective work function, electron scattering coefficient, thermal stability, mechanical properties, etc.) are important factors to determine the electron emission characteristics.

The thickness of the carbon films is preferably in the range of not more than 50 nm and more preferably in the range of not more than 30 nm.

5) Next carried out is the step of introducing nitrogen into the carbon films deposited on the device by the activation operation.

In this nitrogen introducing step, a plasma process is carried out using nitrogen gas alone or the mixed gas of inert gas and nitrogen. In the plasma process a high-frequency plasma (13.56 MHz) is normally employed. If the plasma power is too high sputtering of the carbon films will occur to the contrary to etch the carbon films 10. Therefore, the plasma power is preferably a relatively low power.

The carbon content in the carbon films is controlled by controlling a mixture ratio of nitrogen gas and inert gas, the total pressure of the plasma, the plasma power, or the like.

6) The electron-emitting device thus produced is then subjected preferably to the stabilization step. This step is a step of evacuating the inside of the vacuum chamber in which the electron-emitting device is set, in order to remove water, hydrocarbons, etc. adhering to the device when the device was taken out of the vacuum chamber once to the atmosphere for the plasma process.

It is desirable to eliminate the organic substance out of the vacuum vessel, and the partial pressure of the organic substance is preferably not more than 1 to $3\times10^{-8}$ Pa. The pressure of the gas including the other gases is preferably not more than 1 to $3\times10^{-6}$ Pa and particularly preferably not more than $1\times10^{-7}$ Pa. The evacuation unit for evacuating the vacuum vessel is preferably one not using oil in order to prevent the oil from the unit from affecting the characteristics of the device. Specifically, the evacuation unit can be selected, for example, from vacuum devices such as the absorption pump, the ion pump, the dry pump, the magnetic leviation turbo-pump, and so on. During the evacuation of the inside of the vacuum vessel, the whole vacuum vessel is preferably heated to facilitate the exhaust of the organic molecules adsorbing to the inner wall of the vacuum vessel and to the electron-emitting device. The heating at this time is carried out at 150 to 350° C., and desirably for as long time as possible, preferably at 200° C. or more, but, without having to be limited to these conditions, the conditions are properly selected depending upon various factors including the size and shape of the vacuum vessel, the placement of the electron-emitting device, and so on.

The ambience during the driving after completion of the stabilization step is preferably the one at the end of the above stabilization step, but, without having to be limited to this, sufficiently stable characteristics can be maintained even with some increase of the pressure itself as long as the organic substance is adequately removed.

The employment of the vacuum ambience as described can suppress new deposition of carbon or the carbon compound and maintain the physical properties of the carbon films 10, so that the device current If and emission current Ie are stabilized.

The fundamental characteristics of the electron-emitting device according to the present invention, which was fabricated by the production method as described above, will be described referring to FIG. 4 and FIG. 6.

Figure 6:
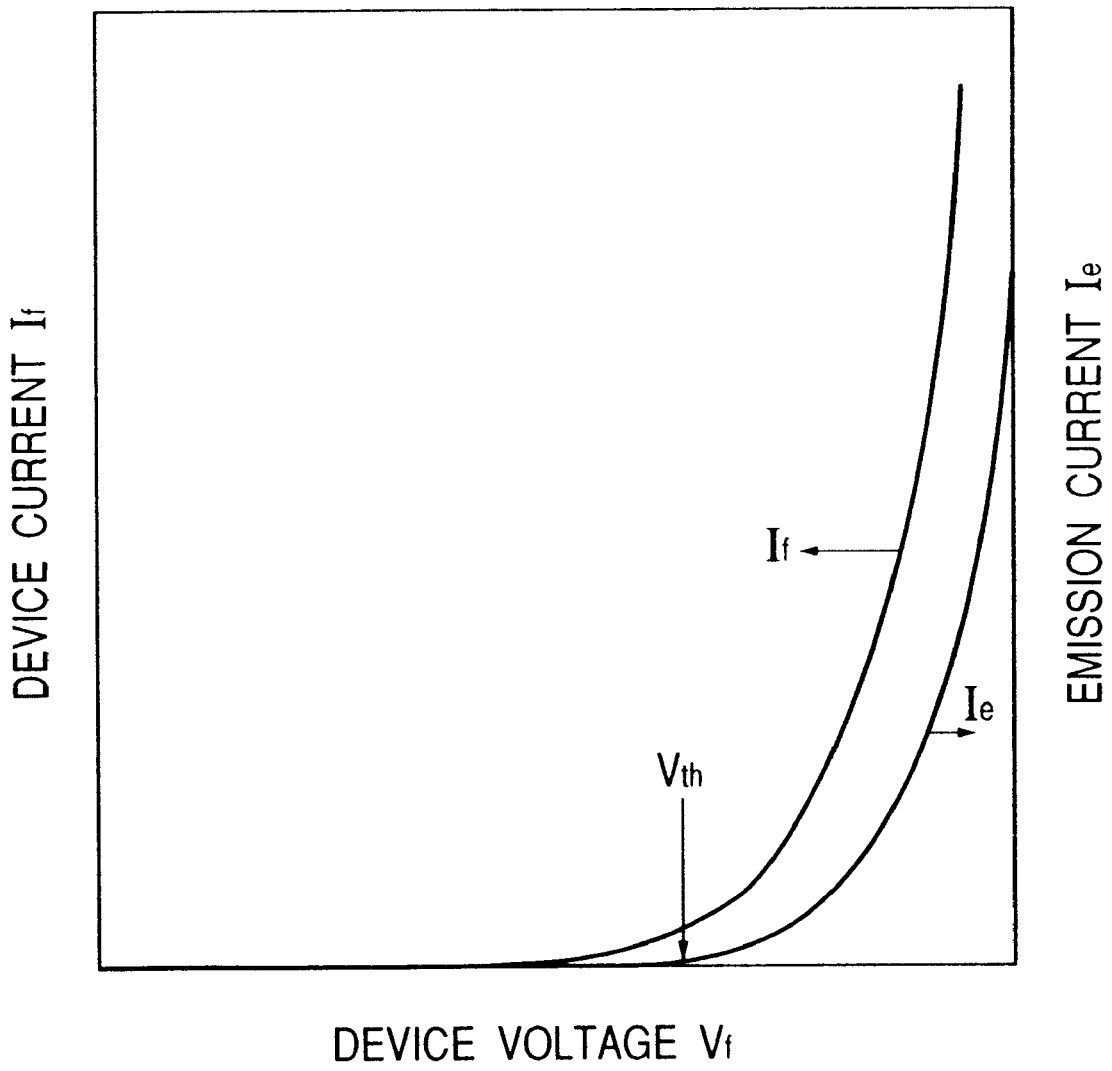
FIG. 6 is a diagram to show the relationship of the emission current Ie and the device current If to the device voltage Vf of the electron-emitting device of the present invention.

FIG. 6 shows a typical example of the relation of the emission current Ie and device current If to the device voltage Vf measured by the measurement-evaluation apparatus shown in FIG. 4. FIG. 6 is illustrated in arbitrary units, because the emission current Ie is extremely smaller than the device current If. As apparent from FIG. 6, the present electron-emitting device has three properties as to the emission current Ie.

First, the present device shows a sudden increase of the emission current Ie with application of the device voltage over a certain voltage (which will be called a threshold voltage, Vth in FIG. 6) and little emission current Ie is detected with application of the device voltage smaller than the threshold voltage Vth. Namely, the device is a nonlinear device having the definite threshold voltage Vth to the emission current Ie.

Second, the emission current Ie is dependent on the device voltage Vf, so that the emission current Ie can be controlled by the device voltage Vf.

Third, the emission charge captured by the anode electrode 44 is dependent on the period of application of the device voltage Vf. Namely, an amount of the charge captured by the anode electrode 44 can be controlled by the period of application of the device voltage Vf.

The electron emission characteristics can be controlled readily according to the input signal, by making use of the characteristics of the electron-emitting device as described above. Further, since the electron-emitting device according to the present invention has the stable and high-luminance electron emission characteristics, it is expected to be applied in various fields.

Examples of application of the electron-emitting device to which the present invention can be applied will be described below.

For example, the electron source or the image-forming apparatus can be constructed by arraying a plurality of electron-emitting devices according to the present invention on the substrate.

The array of devices on the substrate can be arranged, for example, according to either one of the following array configurations. An array configuration (called a ladder type) is such that a lot of electron-emitting devices are arranged in parallel, many rows are arrayed of the electron-emitting devices in a certain direction (called a row direction), the both ends of the individual devices being connected to wires in each row, and electrons are controlled by a control electrode (called a grid) disposed in a space above the electron source in the direction perpendicular to the wires (called a column direction). Another array configuration is such that n Y-directional wires are placed through an interlevel insulating layer above m X-directional wires described hereinafter and an X-directional wire and a Y-directional wire are connected to a pair of device electrodes of each surface conduction electron-emitting device. This will be referred to hereinafter as a simple (passive) matrix configuration.

This simple matrix configuration will be described below in detail.

According to the aforementioned features of the three fundamental properties of the surface conduction electron-emitting device according to the present invention, the electrons emitted from the surface conduction electron-emitting device can be controlled by the peak value and the width of the pulsed voltage applied between the opposed device electrodes in the range over the threshold voltage. On the other hand, few electrons are emitted with the voltage below the threshold voltage. This property permits some surface conduction electron-emitting devices to be selected according to the input signal, so as to control amounts of electrons emitted therefrom, by properly applying the above pulsed voltage to the individual devices even in the configuration of the many electron-emitting devices arrayed.

Figure 7:
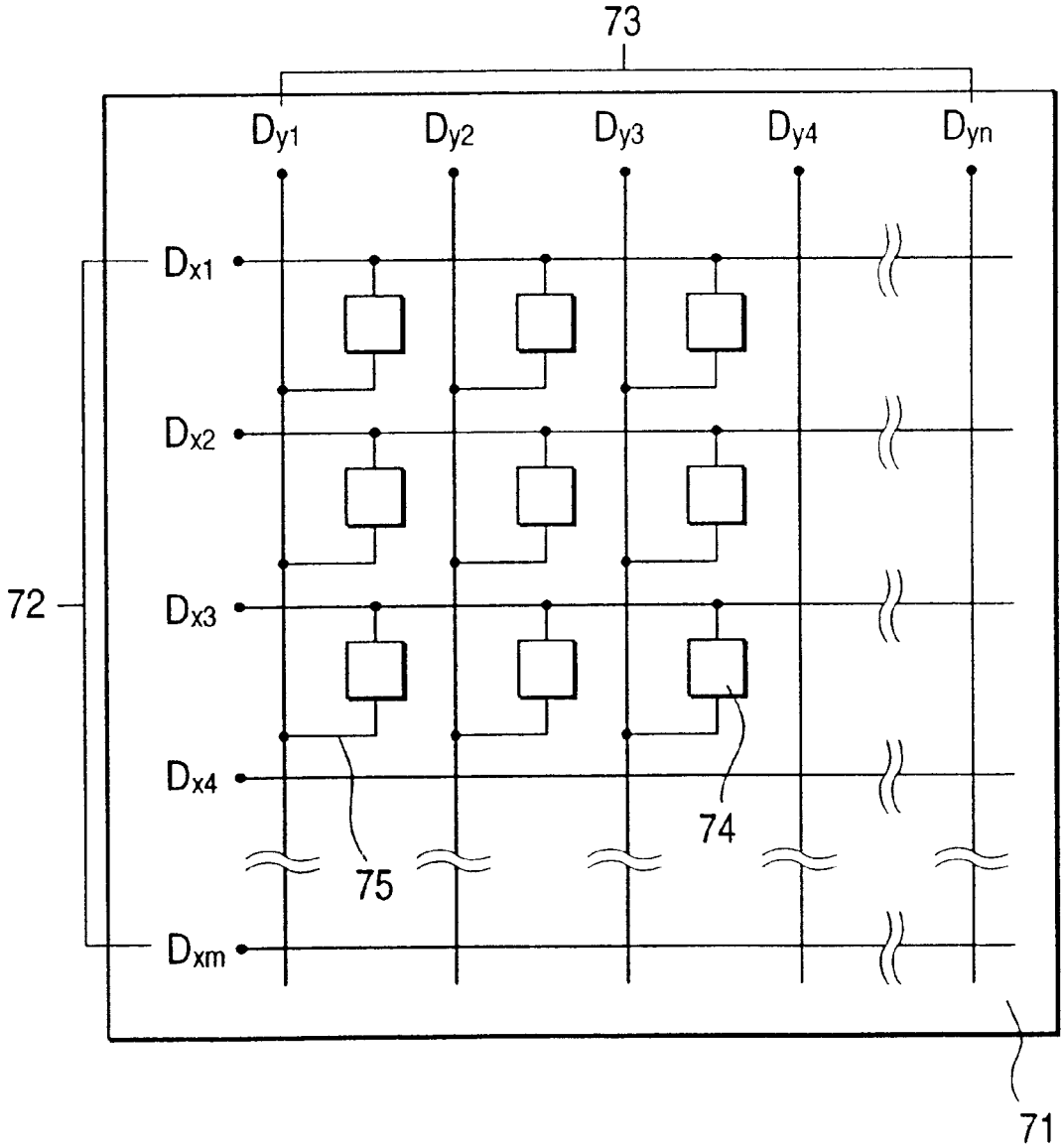
FIG. 7 is a schematic diagram to show an example of the electron source of the simple matrix configuration according to the present invention.

The structure of an electron source substrate constructed based on this principle will be described below referring to FIG. 7.

The m X-directional wires 72 are comprised of Dx1, Dx2, . . . , Dxm, which are made of an electroconductive metal or the like in a desired pattern on the insulating substrate 71 by vacuum evaporation, printing, sputtering, or the like. The material, thickness, and width of the wires, etc. are so designed as to supply almost uniform voltage to the many surface conduction electron-emitting devices. The Y-directional wires 73 are comprised of n wires of Dy1, Dy2, . . . , Dyn and are made of the conductive metal or the like in the desired pattern by the vacuum evacuation, printing, sputtering, or the like, as the X-directional wires 72 are. The material, thickness, and width of the wires are so designed as to supply almost uniform voltage to the many surface conduction electron-emitting devices. An interlevel insulating layer not illustrated is placed between these m X-directional wires 72 and n Y-directional wires 73 to establish electrical insulation between them, thus composing the matrix wiring (where m and n both are positive integers).

The interlevel insulating layer not illustrated is $SiO_2$ or the like formed by vacuum evaporation, printing, sputtering, or the like, which is made in a desired pattern over the entire surface or in part of the insulating substrate 71 on which the X-directional wires 72 are formed. Particularly, the thickness, material, and production method thereof are properly set so as to endure the potential difference at intersections between the X-directional wires 72 and the Y-directional wires 73. The X-directional wires 72 and Y-directional wires 73 are routed out each as an external terminal.

Further, the opposed device electrodes (not illustrated) of the surface conduction electron-emitting devices 74 are electrically connected to the m X-directional wires 72 (Dx1, Dx2, . . . , Dxm) and to the n Y-directional wires 73 (Dy1, Dy2, . . . , Dyn) by connection lines 75 of a conductive metal or the like made by vacuum evaporation, printing, sputtering, or the like, in the same manner as described previously.

Here some or all of the component elements may be common to or different among the conductive metals of the m X-directional wires 72, n Y-directional wires 73, connection lines 75, and opposed device electrodes. These materials are properly selected, for example, from the aforementioned materials for the device electrodes.

Although the details will be described hereinafter, an unillustrated scanning signal applying means for supplying a scanning signal for scanning of the rows of the surface conduction electron-emitting devices 74 arrayed in the X-direction according to the input signal is electrically connected to the X-directional wires 72, while an unillustrated modulation signal generating means for supplying a modulation signal for modulating each column of the surface conduction electron-emitting devices 74 arrayed in the Y-direction according to the input signal is electrically connected to the Y-directional wires 73. The driving voltage applied to each of the surface conduction electron-emitting devices is supplied as a difference voltage between the scanning signal and the modulation signal applied to the device.

Figure 8:
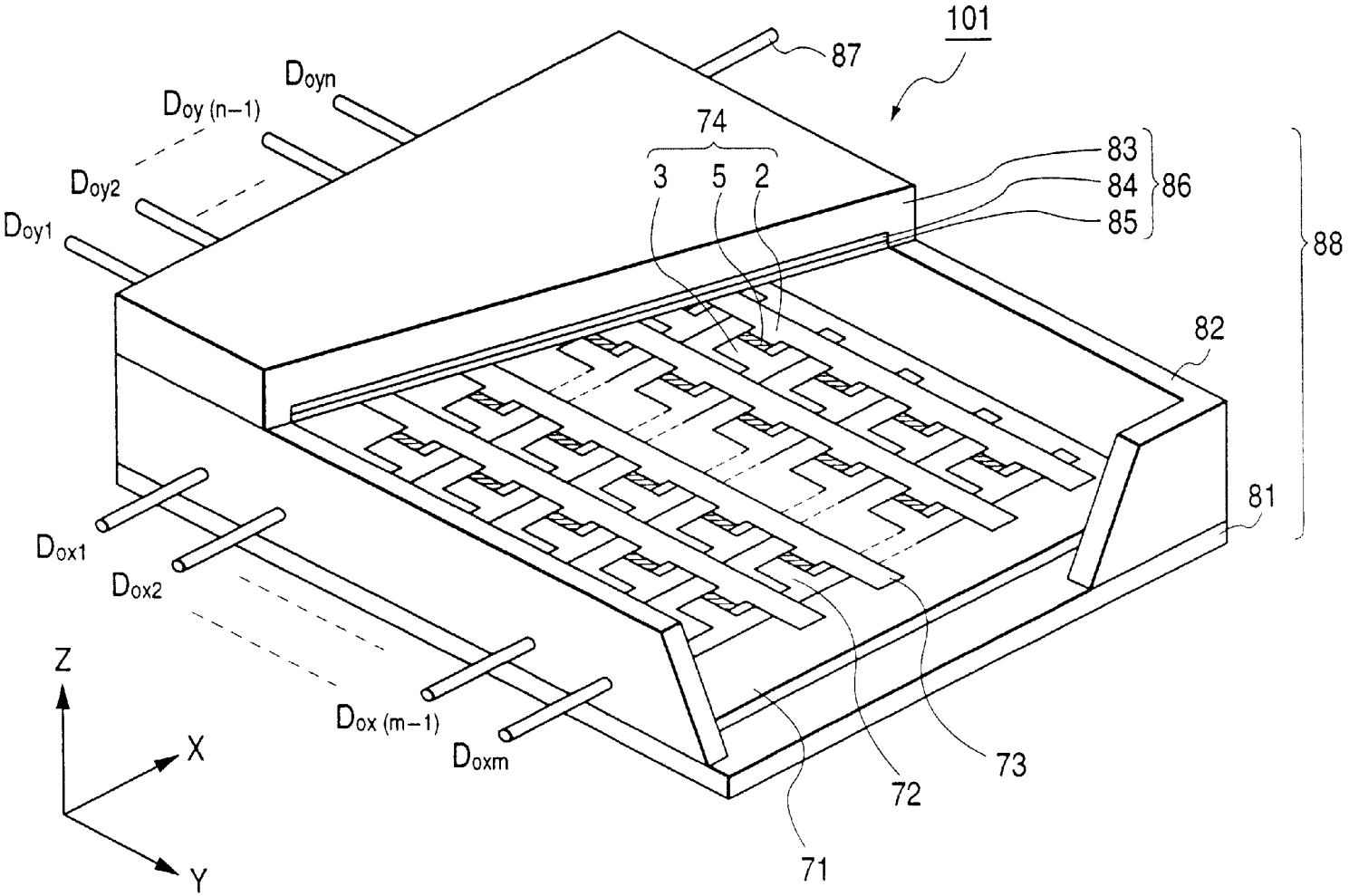
FIG. 8 is a schematic diagram to show an example of a display panel in the image-forming apparatus according to the present invention.
Figure 9A:
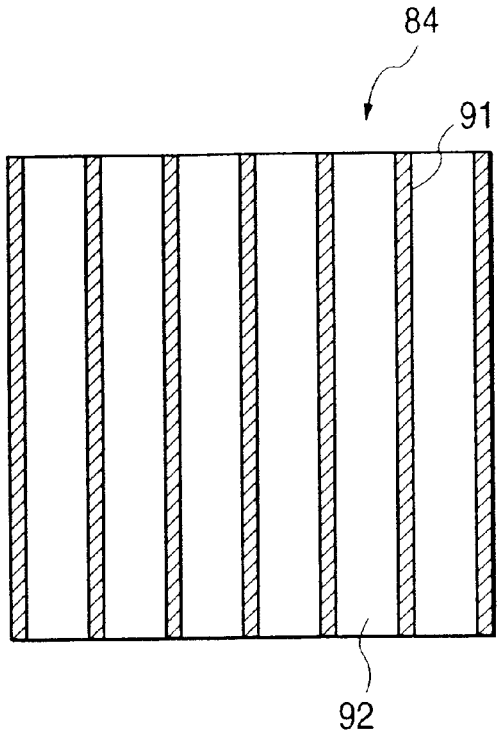
FIG. 9A and FIG. 9B are schematic diagrams to show examples of fluorescent films.
Figure 9B:
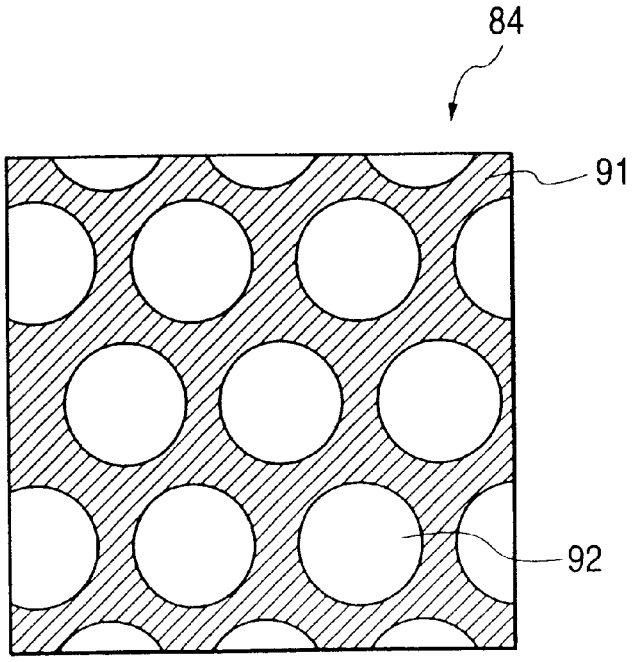

Next described referring to FIG. 8 and FIGS. 9A and 9B is an example of the electron source using the electron source substrate of the simple matrix configuration as described above, and the image-forming apparatus used for display or the like. FIG. 8 is a diagram to show the fundamental structure of the image-forming apparatus and FIGS. 9A and 9B illustrate fluorescent films.

In FIG. 8, numeral 71 represents the electron source substrate in which a plurality of electron-emitting devices are arrayed, 81 a rear plate to which the electron source substrate 71 is fixed, and 86 a face plate in which a fluorescent film 84, a metal back 85, etc. are formed on an internal surface of glass substrate 83. Numeral 82 indicates a support frame, and the rear plate 81, support frame 82, and face plate 86 are coated with frit glass and baked at 400 to 500° C. in the atmosphere or in nitrogen for ten or more minutes, so as to seal them, thereby composing an envelope 88.

In FIG. 8, numeral 74 denotes devices corresponding to the surface conduction electron-emitting devices shown in FIGS. 1A, 1B or in FIG. 2.

Numerals 72 and 73 denote the X-directional wires and Y-directional wires connected to the pairs of device electrodes of the surface conduction electron-emitting devices. If the wires to these device electrodes are made of the same wiring material as the device electrodes, they will also be called the device electrodes in some cases.

The envelope 88 is comprised of the face plate 86, the support frame 82, and the rear plate 81 as described above. Since the rear plate 81 is provided mainly for the purpose of reinforcing the strength of the substrate 71, the separate rear plate 81 can be omitted if the substrate 71 itself has sufficient strength. Namely, the support frame 82 may be bonded directly to the substrate 71, whereby the envelope 88 can be constructed of the face plate 86, the support frame 82, and the substrate 71.

As another example, the envelope 88 can also be constructed with sufficient strength against the atmospheric pressure by mounting an unrepresented support called a spacer between the face plate 86 and the rear plate 81.

FIGS. 9A and 9B illustrate the fluorescent films. The fluorescent film 84 is constructed of only a fluorescent material in the monochrome case. In the case of a color fluorescent film, the fluorescent film is constructed of fluorescent materials 92 and a black conductive material 91 called black stripes (FIG. 9A) or a black matrix (FIG. 9B) depending upon the array of the fluorescent materials. Purposes of provision of the black stripes or the black matrix are to make color mixture or the like unobstructive by blacking the spaces between the fluorescent materials 92 of the three primary colors necessitated in the case of the color display, and to suppress decrease in contrast due to reflection of ambient light on the fluorescent film 84. A material for the black conductive material 91 can be selected from materials including the principal component of graphite commonly widely used, and, without having to be limited thereto, it can also be selected from any electrically conductive materials with little transmission and little reflection of light.

A method for applying the fluorescent materials to the glass substrate 83 is selected from a precipitation method, a printing method, and the like, in either the monochrome or the color case.

The metal back 85 is normally provided on the inner surface of the fluorescent film 84. Purposes of the metal back are to enhance the luminance by specular reflection of light traveling to the inside out of the light emitted from the fluorescent materials, toward the face plate 86, to use the metal back as an electrode for applying the electron beam acceleration voltage, to protect the fluorescent material from damage due to collision of negative ions generated in the envelope, and so on. The metal back can be fabricated after production of the fluorescent film by carrying out a smoothing operation (normally called filming) of the inside surface of the fluorescent film and thereafter depositing A1 by vacuum evaporation or the like.

The face plate 86 may be provided with a transparent electrode (not illustrated) on the outer surface side of the fluorescent film 84 in order to enhance the electrically conductive property of the fluorescent film 84.

On the occasion of carrying out the aforementioned sealing, adequate position alignment is necessary in the color case in order to match the electron-emitting devices with the respective color fluorescent materials.

The envelope 88 is sealed after evacuated to the vacuum degree of about $1.3\times10^{-5}$ Pa through an unrepresented exhaust pipe. In certain cases a getter operation is also carried out in order to maintain the vacuum degree after the sealing of the envelope 88. This getter operation is an operation for heating a getter (not illustrated) placed at a predetermined position in the envelope 88 by a heating method such as resistance heating or high-frequency heating to form an evaporated film, immediately before or after the execution of the sealing of the envelope 88. The getter normally contains a principal component of Ba or the like, and maintains, for example, the vacuum degree of $1\times10^{-5}$ to $1\times10^{-7}$ Pa by adsorption action of the evaporated film.

In the image displaying apparatus of the present invention completed as described above, the voltage is applied to each electron-emitting device through the external terminals outside the container, Dox1 to Doxm and Doy1 to Doyn, to make the device emit electrons, the high voltage of not less than several kV is applied to the metal back 85 or to the transparent electrode (not illustrated) through a high-voltage terminal 87 to accelerate electron beams, and the electron beams are guided onto the fluorescent film 84 to bring about excitation and luminescence thereof, thereby displaying an image.

It should be noted that the structure described above is the schematic structure necessary for the fabrication of the suitable image-forming apparatus used for display or the like and that the details, for example such as the material for each member, can be properly selected so as to suit application of the image-forming apparatus, without having to be limited to the contents described above.

Figure 10:
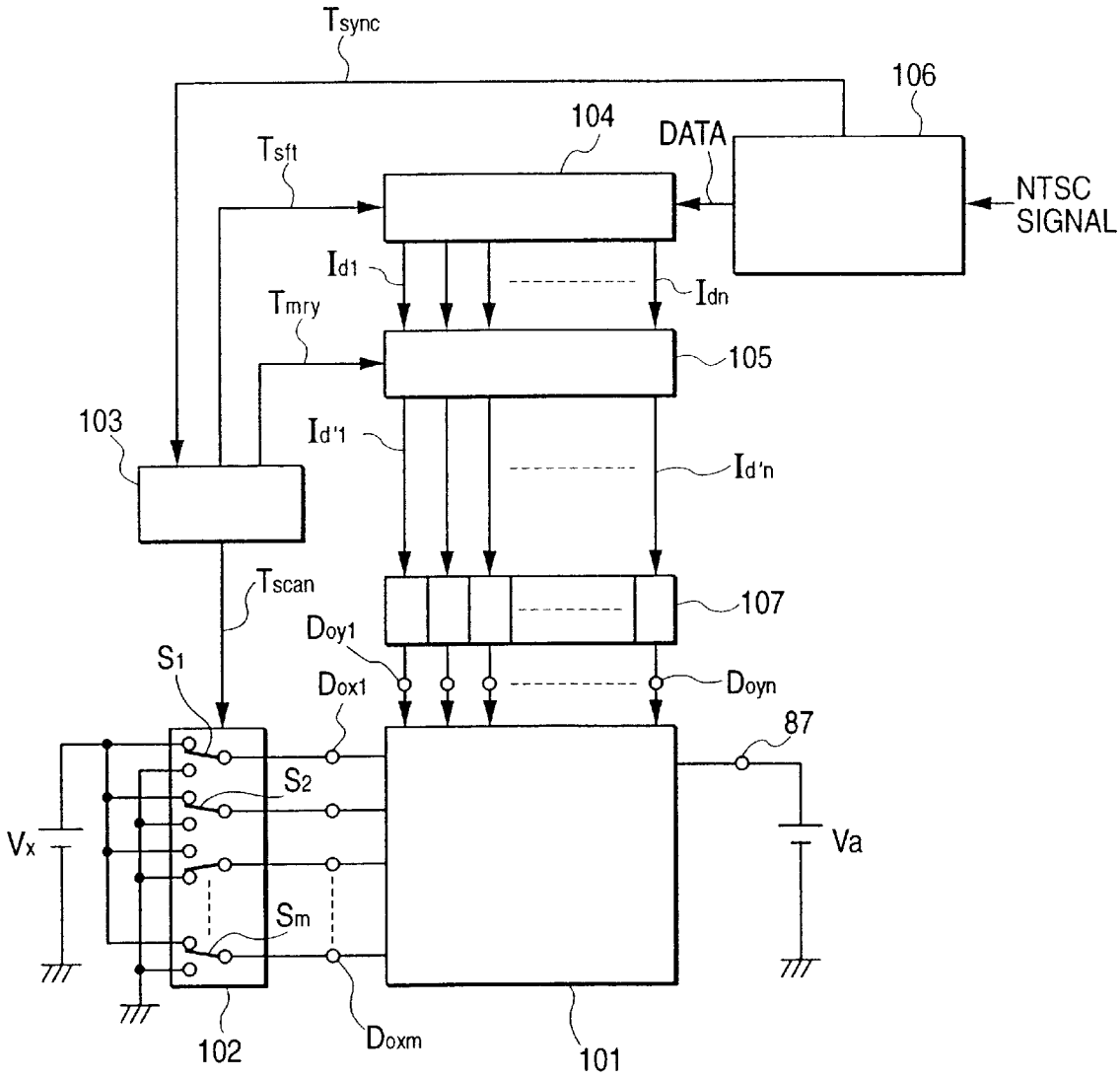
FIG. 10 is a block diagram to show an example of a driving circuit for displaying an image according to NTSC television signals in the image-forming apparatus according to the present invention.

Next described referring to FIG. 10 is a structural example of the driving circuit for performing the television display based on TV signals of the NTSC system, on the display panel constructed using the electron source of the simple matrix configuration.

FIG. 10 is a block diagram to show an example of the driving circuit for effecting the display according to the TV signals of the NTSC system. In FIG. 10, numeral 101 designates the display panel, 102 a scanning signal generating circuit, 103 a timing control circuit, 104 a shift register, 105 a line memory, 106 a synchronous signal separator, 107 a modulation signal generator, and Vx and Va dc voltage supplies.

The display panel 101 is connected to the external, electric circuits through the terminals Dox1 to Doxm, the terminals Doy1 to Doyn, and the high-voltage terminal 87. Applied to the terminals Dox1 to Doxm are scanning signals for successively driving the electron source provided in the display panel 101, i.e., the group of surface conduction electron-emitting devices matrix-wired in the matrix of m rows x n columns row by row (every n devices). Applied to the terminals Doy1 to Doyn are modulation signals for controlling an output electron beam from each of the surface conduction electron-emitting devices in a row selected by the scanning signal. The dc voltage, for example, of 10 kV is supplied from the dc voltage supply Va to the high-voltage terminal 87, and this is the acceleration voltage for imparting sufficient energy for excitation of the fluorescent material to the electron beams emitted from the electron-emitting devices.

The scanning signal generating circuit 102 is provided with m switching devices inside (which are schematically indicated by S1 to Sm in the drawing). Each switching device selects either the output voltage of the dc voltage supply Vx or 0 V (the ground level) to be electrically connected to the terminal Dox1 to Doxm of the display panel 101. Each switching device of S1 to Sm operates based on the control signal Tscan outputted from the control circuit 103, and can be constructed of a combination of such switching devices as FETs, for example.

The dc voltage supply Vx in the present example is so set as to output such a constant voltage that the driving voltage applied to the devices not scanned is not more than the electron emission threshold voltage, based on the characteristics (the electron emission threshold voltage) of the surface conduction electron-emitting devices.

The timing control circuit 103 has a function of matching operations of the respective sections so as to achieve the appropriate display based on the image signals supplied from the outside. The timing control circuit 103 generates each control signal of Tscan, Tsft, and Tmry to each section, based on the synchronous signal Tsync sent from the synchronous signal separator 106.

The synchronous signal separator 106 is a circuit for separating a synchronous signal component and a luminance signal component from the TV signal of the NTSC method supplied from the outside, which can be constructed using an ordinary frequency separator (filter) circuit or the like. The synchronous signal separated by the synchronous signal separator 106 is composed of a vertical synchronous signal and a horizontal synchronous signal, but it is illustrated as a Tsync signal herein for convenience' sake of description. The luminance signal component of image separated from the aforementioned TV signal is indicated by DATA signal for convenience' sake. The DATA signal is inputted into the shift register 104.

The shift register 104 is a register for performing serial/parallel conversion for each line of image of the aforementioned DATA signal serially inputted in time series, which operates based on the control signal Tsft sent from the timing control circuit 103 (this means that the control signal Tsft can be said to be a shift clock of the shift register 104). The data of each image line after the serial/parallel conversion (corresponding to the driving data for the n electron-emitting devices) is outputted as n parallel signals of Id1 to Idn from the shift register 104.

The line memory 105 is a storage device for storing the data of one image line during a necessary period, which properly stores the data of Id1 to Idn according to the control signal Tmry sent from the timing control circuit 103. The stored data is outputted as Id'1 to Id'n to the modulation signal generator 107.

The modulation signal generator 107 is a signal source for properly modulating driving of each of the electron-emitting devices according to each of the image data Id'1 to Id'n, and output signals therefrom are applied through the terminals Doy1 to Doyn to the surface conduction electron-emitting devices in the display panel 101.

As described previously, the electron-emitting devices, to which the present invention can be applied, have the following fundamental characteristics concerning the emission current Ie. Specifically, there is the definite threshold voltage Vth for electron emission, so that electron emission occurs only upon application of the voltage over Vth. With voltages over the electron emission threshold voltage, the emission current also varies according to change in the voltage applied to the device. It is seen from this fact that when pulses of the voltage are applied to the present devices, no electron emission occurs with application of the voltage below the electron emission threshold voltage, but the electron beams are outputted with application of the voltage over the electron emission threshold, for example. On that occasion, the intensity of an output electron beam can be controlled by changing the peak value Vm of the pulses. It is also possible to control a total amount of charge of the output electron beam by changing the width Pw of the pulses. Accordingly, the voltage modulation method, the pulse width modulation method, or the like can be employed as a method for modulating the electron-emitting devices according to the input signal.

For carrying out the voltage modulation method, the modulation signal generator 107 can be a circuit of the voltage modulation method for generating voltage pulses of a constant length and properly modulating peak values of the pulses according to input data.

For carrying out the pulse width modulation method, the modulation signal generator 107 can be a circuit of the pulse width modulation method for generating voltage pulses of a constant peak value and properly modulating widths of the voltage pulses according to the input data.

The shift register 104 and the line memory 105 can be of either the digital signal type or the analog signal type. The point is that the serial/parallel conversion and storage of image signal should be carried out at a predetermined rate.

For use of the digital signal type, the output signal DATA of the synchronous signal separator 106 needs to be digitized. For this purpose, the output section of the synchronous signal separator 106 is provided with an A/D converter. In connection with it, the circuit used in the modulation signal generator 107 will slightly differ depending upon whether the output signals of the line memory 105 are digital signals or analog signals. In the case of the voltage modulation method using digital signals, the modulation signal generator 107 is, for example, a D/A converter and an amplifier is added if necessary. In the case of the pulse width modulation method, the modulation signal generator 107 is a circuit, for example, comprised of a high-speed oscillator, a counter for counting waves outputted from the oscillator, and a comparator for comparing an output value of the counter with an output value of the memory. The circuit may also be provided with an amplifier for amplifying the voltage of the modulation signal modulated in the pulse width from the comparator to the driving voltage of the electron-emitting devices, if necessary.

In the case of the voltage modulation method using analog signals, the modulation signal generator 107 can be an amplifying circuit, for example, using an operational amplifier and may also be provided with a level shift circuit if necessary. In the case of the pulse width modulation method, a voltage-controlled oscillator (VCO) can be employed, for example, and it can also be provided with an amplifier for amplifying the voltage to the driving voltage of the electron-emitting devices, if necessary.

In the image-forming apparatus to which the present invention can be applied and which can be constructed as described above, electron emission occurs when the voltage is applied through the terminals Dox1 to Doxm, Doy1 to Doyn outside the container to each electron-emitting device. The electron beams are accelerated by applying the high voltage through the high voltage terminal 87 to the metal back 85 or to the transparent electrode (not illustrated). The electrons thus accelerated collide with the fluorescent film 84 to bring about luminescence, thus forming the image.

It should be noted that the structure of the image-forming apparatus stated herein is just an example of the image-forming apparatus to which the present invention can be applied, and it can involve a variety of modifications based on the technological thought of the present invention. Although the NTSC system was exemplified for the input signals, the input signals can be of the PAL system, the SECAM system, or the like, or a system of TV signals including more scanning lines (for example, one of high-definition TV systems including the MUSE system) without having to be limited to the NTSC system.

The electron source and image-forming apparatus of the aforementioned ladder type configuration will be described referring to FIG. 11 and FIG. 12.

Figure 11:
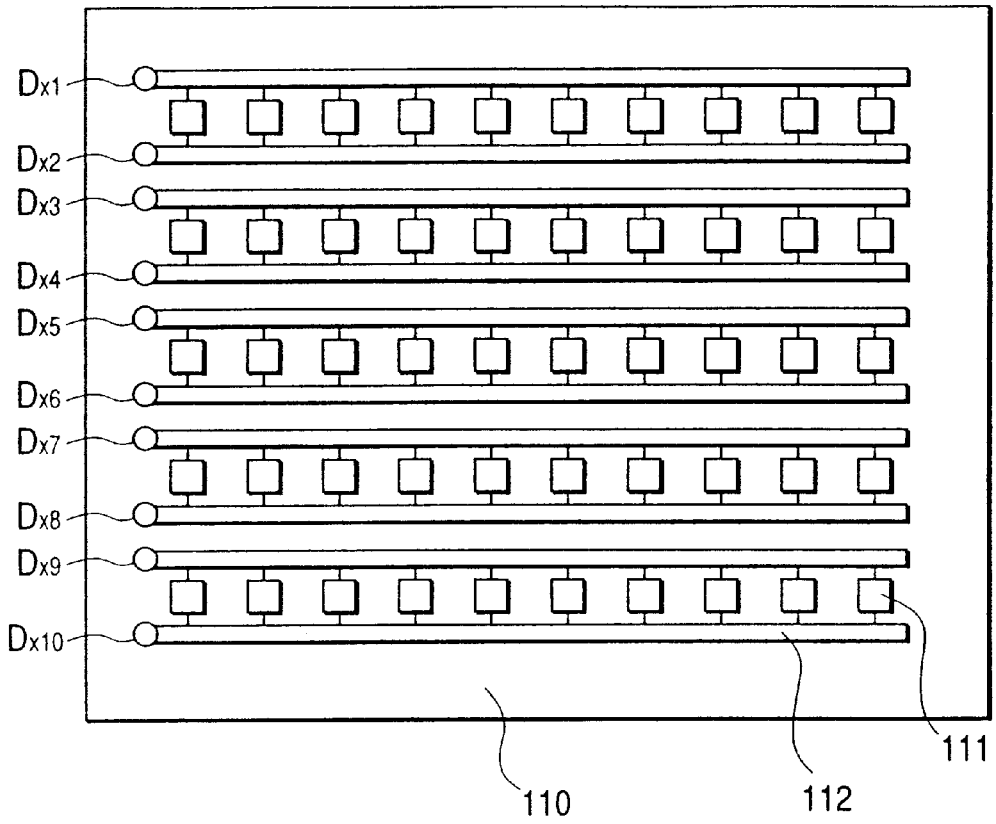
FIG. 11 is a schematic diagram to show an example of the electron source of a ladder configuration according to the present invention.

FIG. 11 is a schematic diagram to show an example of the electron source of the ladder type configuration. In FIG. 11, numeral 110 represents the electron source substrate and 111 the electron-emitting devices. Numeral 112 denotes common wires Dx1 to Dx10 for connecting the electron-emitting devices 111 and they are drawn out as external terminals. A plurality of electron-emitting devices 111 are arranged in parallel in the X-direction (which will be called device rows) on the substrate 110. A plurality of device rows are provided to compose an electron source. Each device row can be driven independently by applying a driving voltage between the common wires of each device row. Specifically, a voltage exceeding the electron emission threshold is applied to a device row expected to emit the electron beams, whereas a voltage below the electron emission threshold is applied to a device row not expected to emit the electron beams. The common wires Dx2 to Dx9 between the device rows can be shared; for example, each pair of Dx2 and Dx3, Dx4 and Dx5, Dx6 and Dx7, or Dx8 and Dx9, can be constructed of a single wire.

Figure 12:
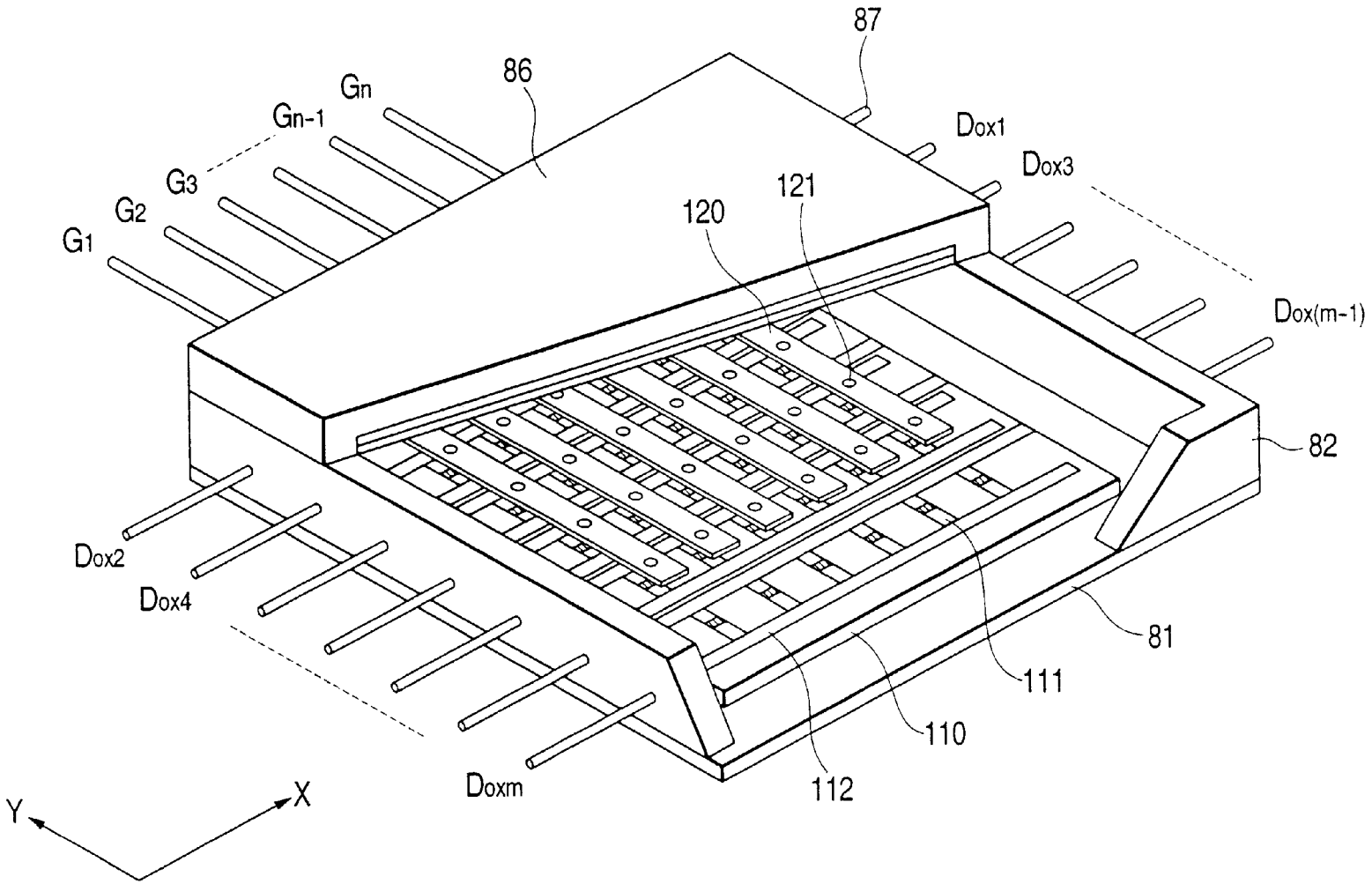
FIG. 12 is a schematic diagram to show another example of the display panel in the image-forming apparatus according to the present invention.

FIG. 12 is a schematic diagram to show an example of the panel structure in the image-forming apparatus provided with the electron source of the ladder type configuration. Numeral 120 is the grid electrode, 121 openings through which electrons pass, Dox1 to Doxm external terminals outside the vessel, and G1 to Gn external terminals connected to the grid electrode 120. Numeral 110 represents the electron source substrate where the common wires between the device rows are shared. In FIG. 12, the same portions as those illustrated in FIG. 8 and FIG. 11 are denoted by the same reference symbols as those in these figures. A significant difference between the image-forming apparatus shown herein and the image-forming apparatus of the simple matrix configuration shown in FIG. 8 is whether or not the grid electrode 120 is provided between the electron source substrate 110 and the face plate 86.

In FIG. 12, there is the grid electrode 120 provided between the substrate 110 and the face plate 86. The grid electrode 120 is provided for modulating the electron beams emitted from the electron-emitting devices 111 and is provided with circular apertures 121, one each per device, for allowing the electron beams to pass toward the electrodes of the stripe pattern provided perpendicular to the device rows of the ladder type configuration. The shape and placement position of the grid are not limited to those shown in FIG. 12. For example, the apertures may be a lot of passing pores of a mesh pattern, and the grid electrode can also be located around or near the electron-emitting devices.

The external terminals Dox1 to Doxm and the grid external terminals G1 to Gn outside the container are electrically connected to a control circuit not illustrated.

In the image-forming apparatus of the present example, a modulation signal for one line of image is simultaneously applied to each grid electrode column in synchronism with successive driving (scanning) of the device rows row by row. This permits control of radiation of each electron beam to the fluorescent member, whereby an image can be displayed line by line.

The image-forming apparatus of the present invention can be applied to the display devices for television broadcasting, the display devices for television conference systems, computers, and so on, the image-forming apparatus as an optical printer constructed using a photosensitive drum etc., and so on.

EXAMPLES

The present invention will be described in further detail with examples thereof.

Example 1

The basic structure of the electron-emitting device in the present example is the same as that illustrated in the plan view and sectional view of FIG. 1A and FIG. 1B.

The production method of the surface conduction electron-emitting device in the present example is fundamentally the same as the one illustrated in FIGS. 3A to 3D. The basic structure and production method of the device according to the present example will be described referring to FIGS. 1A, 1B and FIGS. 3A to 3D.

The production method will be described below in order referring to FIGS. 1A, 1B and FIGS. 3A to 3D.

(Step-a)

First, a photoresist (RD-2000N-41 available from Hitachi Kasei) was formed in the pattern expected to become the device electrodes 2, 3 and the desired gap L between the device electrodes on quartz substrate 1 after cleaned, and Ti and Pt were successively deposited in the thickness of 5 nm and in the thickness of 30 nm, respectively, by vacuum evaporation. Then the photoresist pattern was dissolved with an organic solvent and the Pt/Ti deposited films were lifted off, thereby forming the device electrodes 2, 3 having the device electrode gap L of 3 $\mu$m and the device electrode width W of 300 $\mu$m (FIG. 3A).

(Step-b)

A Cr film was deposited in the thickness 100 nm by vacuum evaporation and was patterned so as to form an aperture corresponding to the shape of the conductive film described hereinafter. An organic palladium compound solution (ccp4230 available from Okuno Seiyaku K. K.) was applied onto the film by spin coating with a spinner and it was baked at 350° C. for twelve minutes. The conductive film 4 containing the principal element of Pd, thus made, had the thickness of 10 nm and the sheet resistance Rs of $2\times10^4$ Ω/□.

(Step-c)

The Cr film and the conductive film 4 after baked were etched with an acid etchant, thereby forming the desired pattern (FIG. 3B).

According to the above steps, the device electrodes 2, 3 and conductive film 4 were formed on the substrate 1.

(Step-d)

Then the above device was set in the measurement-evaluation apparatus of FIG. 4 and the inside was evacuated by the vacuum pump. After the pressure reached the vacuum level of $2.7\times10^{-4}$ Pa, the voltage was placed between the device electrodes 2, 3 of the device from the power supply 41 for applying the device voltage Vf to the device, thus carrying out the forming operation. This operation formed the gap 6 in part of the conductive film (FIG. 3C). The voltage waveform in the forming operation was that shown in FIG. 5B.

In FIG. 5B, T1 and T2 indicate the pulse width and pulse spacing of the voltage waveform. In the present example, the forming operation was carried out under such conditions that T1 was 1 msec, T2 was 10 msec, and the peak values of the triangular waves were increased in steps of 0.1 V. During the forming operation a resistance measuring pulse at the voltage of 0.1 V was also interposed between the pulses for the forming and the resistance was measured thereby. The end of the forming operation was determined at the time when a measured value by the resistance measuring pulse became not less than about 1 MΩ and, at the same time, the application of the voltage to the device was terminated.

(Step-e)

Figure 13:
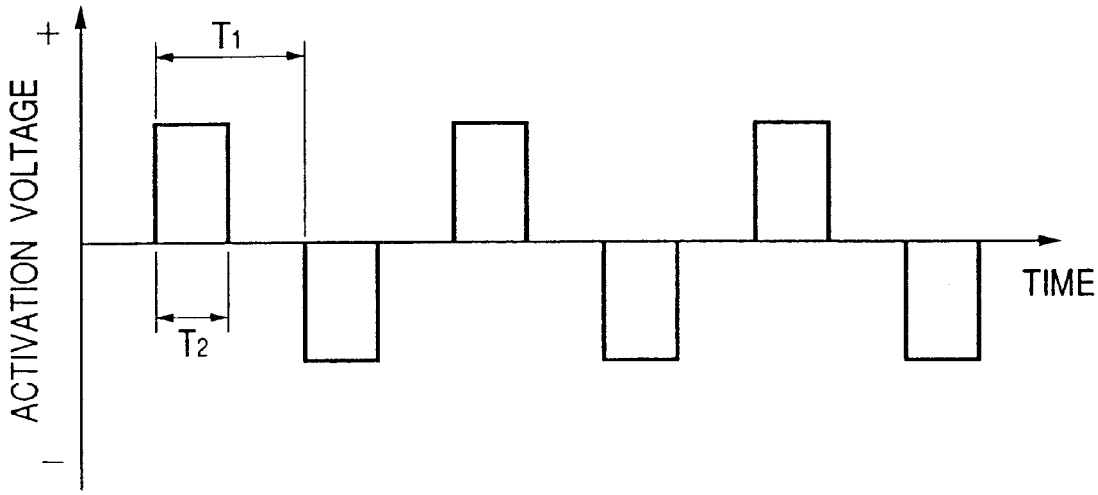
FIG. 13 is a schematic diagram to show an example of voltage waveform in the activation operation, which can be adopted in the production of the electron-emitting device of the present invention.

For carrying out the activation step next, acetone ($CH_3$–CO–$CH_3$) preliminarily sealed in an ampul was introduced through a slow leak valve into the vacuum chamber and the pressure of $1.3\times10^{-3}$ Pa was maintained. Then the activation operation was carried out on the device after the forming operation, by applying the voltage of the waveform illustrated in FIG. 13 through the device electrodes 2, 3 to the device under the condition that the maximum voltage was 15 V. Since If values saturated about 30 minutes after, the energization was stopped and the slow leak valve was closed, to terminate the activation operation, thereby forming the carbon-containing films (carbon films) on the substrate in the second gap 6 formed in part of the conductive film and on the conductive films near the second gap 6. The carbon-containing films (carbon films) 10 were laid opposite to each other on the both sides of the first gap 7 located inside the second gap 6 and having the narrower width than the second gap 6 (FIG. 3D).

(Step-f)

After that, the device was taken out and the nitrogenization treatment (nitrogen introducing step) was carried out. For comparison's sake, samples were also prepared without the nitrogenization treatment and with different nitrogen contents under various conditions.

At this time, the nitrogen contents were controlled by the plasma process with only nitrogen and by variations of contents of nitrogen and inert gas (Ar). Partial pressures of the gases ($N_2$:Ar) at this time were 100:0, 80:20, 50:50, 30:70, 15:85, 5:95, 3:97, 2:98, 1:99, and 0:100. The total pressure during the plasma process was about 2.7 Pa and the RF (high frequency) power was 3 W/cm$^2$. The time of the plasma process was five minutes for all the samples.

After that, the samples were analyzed by the aforementioned XPS analysis to measure values of ratios of nitrogen atoms to carbon atoms in the carbon film kept at the higher potential (the electrode 2) during the driving (N (nitrogen)/C (carbon) ratios). The results are shown in Table 1. In the measurement by XPS the samples were measured after baked at 200° C. in vacuum. This is for avoiding the influence of adsorbing water and hydrocarbons resulting from the exposure to the atmosphere.

TABLE 1

| Gas treatment $N_2$:Ar | no | 1:99 | 2:98 | 3:97 | 5:95 | 15:85 | 30:70 | 50:50 | 80:20 | 100:0 |
|---|---|---|---|---|---|---|---|---|---|---|
| N/C ratio | 0 | 1/100 | 2/100 | 3/100 | 5/100 | 7/100 | 10/100 | 15/100 | 18/100 | 25/100 |

The electron-emitting devices having the various N/C ratios prepared as described above were evaluated as to the electron emission characteristics.

First, each electron-emitting device was put again into the vacuum chamber of FIG. 4 and subjected to the stabilization operation. At this time, each device was baked at 250° C. for ten hours, and then the stabilization step was terminated.

The measurement of the electron emission characteristics was carried out while applying the voltage higher by 15 V to the electrode 2 than to the electrode 3 under such conditions that the distance H between the anode electrode 44 and the electron-emitting device was 4 mm, the potential of the anode electrode 44 was 1 kV, and the vacuum degree inside the vacuum chamber was $2.7\times10^{-8}$ Pa. Emission current efficiencies of the respective electron-emitting devices at this time are listed in Table 2.

TABLE 2

| N/C ratio | 0 | 1/100 | 2/100 | 3/100 | 5/100 | 7/100 | 10/100 | 15/100 | 18/100 | 25/100 |
|---|---|---|---|---|---|---|---|---|---|---|
| Efficiency | 0.03% | 0.03% | 0.05% | 0.06% | 0.06% | 0.15% | 0.25% | 0.54% | 0.41% | 0.22% |
| Stability | ○ | ○ | ○ | ○ | ○ | ○ | ○ | ○ | Δ | Δ |

NOTE
○: stable
Δ: unstable

It is seen from Table 2 that the electron emission efficiency is increased where nitrogen is introduced into the carbon films so that the ratio of nitrogen atoms to carbon atoms in the carbon films (N (nitrogen)/C (carbon) ratio) is not less than 2/100.

However, the efficiency tends to decrease gradually after the ratio of nitrogen atoms to carbon atoms (N (nitrogen)/C (carbon) ratio) exceeds 15/100. Although the efficiency at this ratio is higher than that of the device containing no nitrogen, the device current becomes instable and the lifetime or the like tends to become shorter. Therefore, it was clarified that the appropriate range of the N/C ratio is not less than 2/100 and not more than 15/100 particularly as a condition for excellent stability and high efficiency. Further, since the efficiency becomes suddenly higher in the range of the N/C ratio greater than 5/100, the N/C ratio is particularly preferably greater than 5/100 and not more than 15/100.

Example 2

The present example is an example of the image-forming apparatus with the electron source in which a lot of surface conduction electron-emitting devices are arrayed in the simple matrix configuration.

Figure 14:
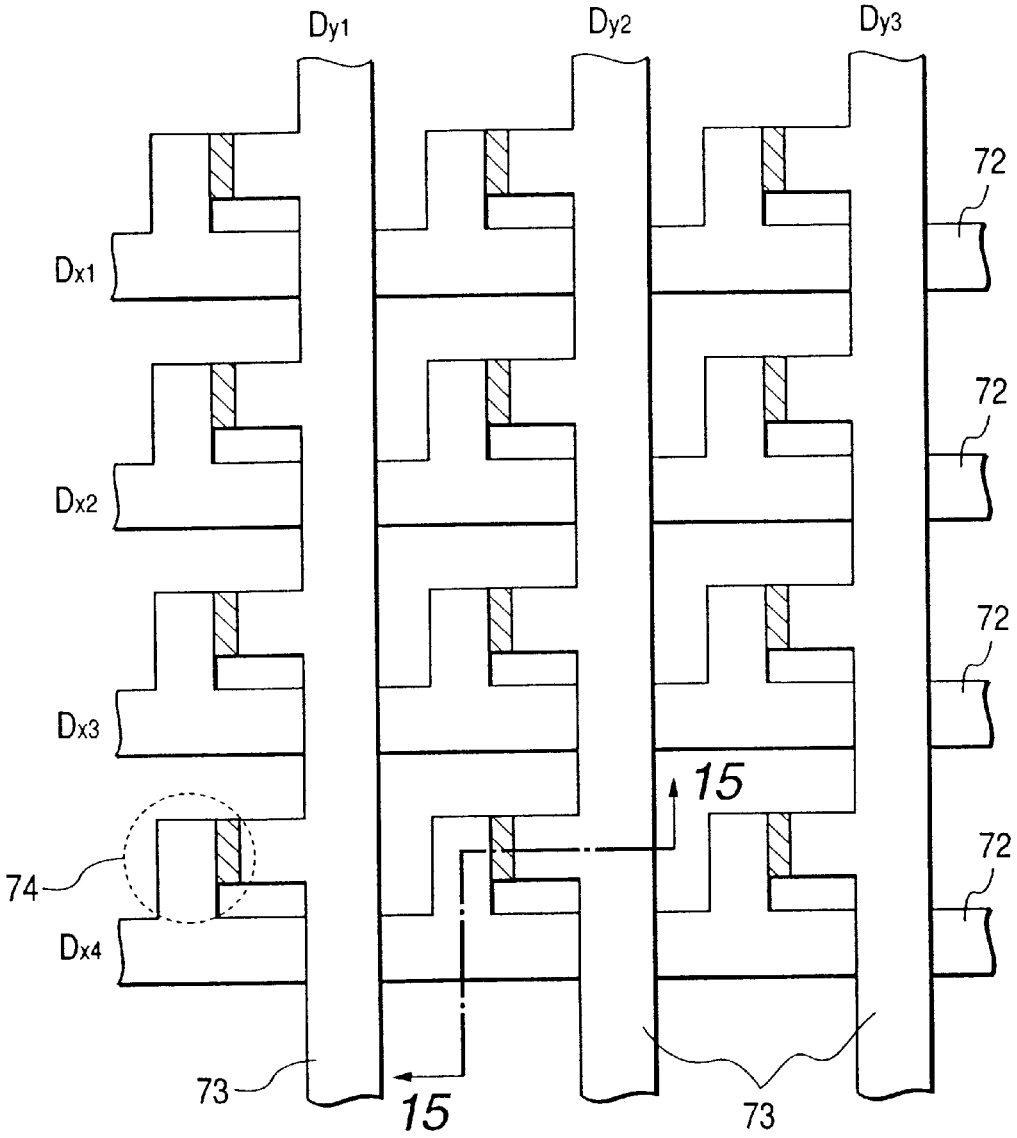
FIG. 14 is a schematic diagram to show a part of the electron source of matrix wiring according to an example of the present invention.
Figure 15:
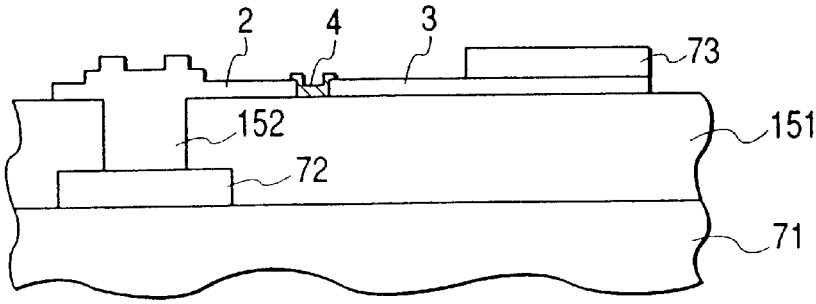
FIG. 15 is a schematic sectional diagram along a line 15—15 in FIG. 14.

A plan view of a part of the electron source is illustrated in FIG. 14. A sectional view along a line 15—15 of FIG. 14 is illustrated in FIG. 15. In FIG. 14 and FIG. 15 the same symbols denote the same elements. Numeral 71 designates the substrate, 72 the X-directional wires (also called lower wires) corresponding to Dxm of FIG. 7, 73 the Y-directional wires (also called upper wires) corresponding to Dyn of FIG. 7, 4 the conductive film, 2 and 3 the device electrodes, 151 the interlevel insulating layer, and 152 a contact hole for electrical connection between the device electrode 2 and the lower wire 72.

The production method will be described in detail according to the sequence of steps by reference to FIGS. 16A to 16D and FIGS. 17A to 17D.

(Step-a)

Figure 16A:
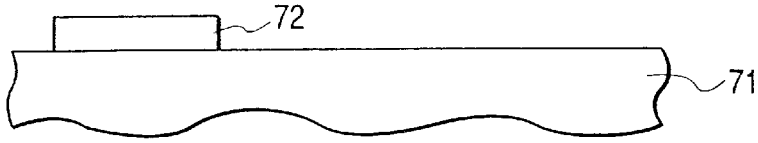
FIG. 16A, FIG. 16B, FIG. 16C, and FIG. 16D are diagrams to show production steps of the electron source of matrix wiring according to an example of the present invention.

On the substrate 71 in which a silicon oxide film 0.5 μm thick was deposited by sputtering on a soda lime glass sheet after cleaned, Cr and Au were successively deposited in the thickness of 5 nm and in the thickness of 0.6 μm, respectively, by vacuum evaporation, and thereafter a photoresist (AZ1370 available from Heochst Inc.) was applied by spin coating with the spinner. Then the photoresist was baked and a photomask image was exposed and developed to form a resist pattern of the lower wires 72. Then the Au/Cr deposited films were wet-etched, thereby forming the lower wires 72 in the desired shape (FIG. 16A).

(Step-b)

Figure 16B:
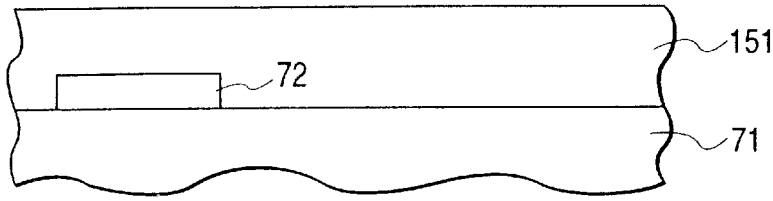

Then the interlevel insulating layer 151 of a silicon oxide film was deposited in the thickness of 1.0 μm by RF sputtering (FIG. 16B).

(Step-c)

Figure 16C:
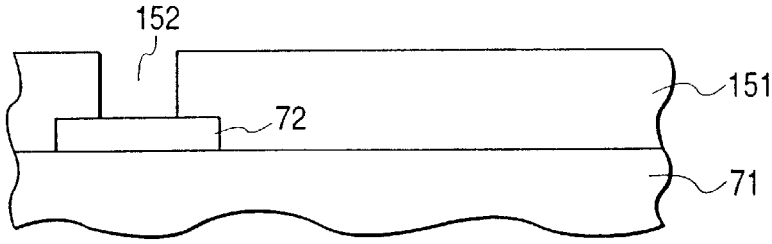

A photoresist pattern for formation of the contact holes 152 was made on the interlevel insulating layer 151 having been deposited in the step-b. Using this pattern as a mask, the interlevel insulating layer 151 was etched to form the contact holes 152 therein (FIG. 16C).

(Step-d)

Figure 16D:
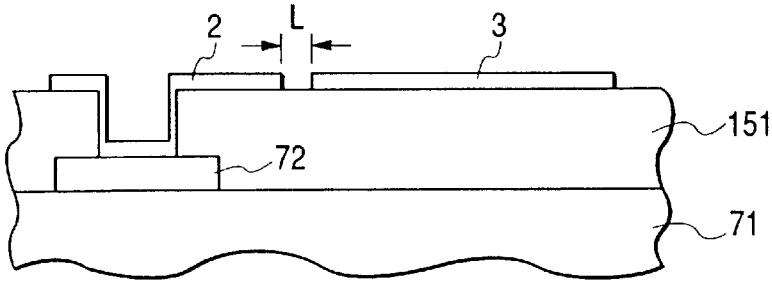

After that, a pattern expected to become the device electrodes 2, 3 and the device electrode gap L was formed with a photoresist (RD-2000N-41 available from Hitachi Kasei K. K.) and then Ti and Ni were successively deposited thereon in the thickness of 5 nm and in the thickness of 0.1 μm, respectively, by vacuum evaporation. The photoresist pattern was then dissolved with an organic solvent and the Ni/Ti deposited films were subjected to lift-off, thereby forming the device electrodes 2, 3 having the device electrode gap L=3 μm and the device electrode width W=0.3 mm (FIG. 16D).

(Step-e)

Figure 17A:
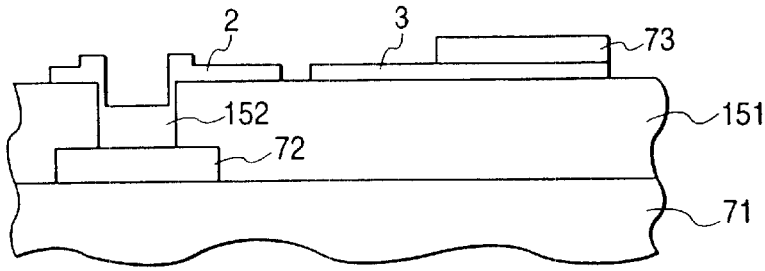
FIG. 17A, FIG. 17B, FIG. 17C, and FIG. 17D are diagrams to show production steps of the electron source of matrix wiring according to an example of the present invention.

A photoresist pattern for the upper wires 73 was formed on the device electrodes 2, 3 and thereafter Ti and Au were successively deposited thereon in the thickness of 5 nm and in the thickness of 0.5 μm, respectively, by vacuum evaporation. Then unnecessary portions were removed by lift-off, thus forming the upper wires 73 in the desired shape (FIG. 17A).

(Step-f)

Figure 17B:
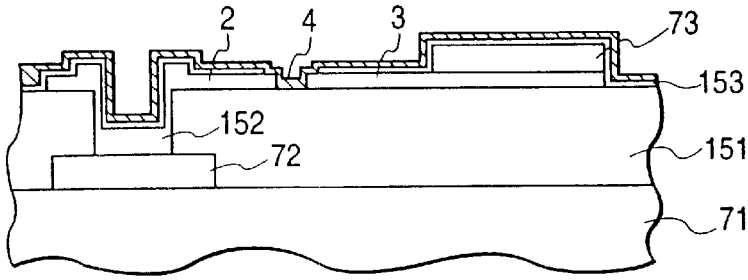

A Cr film 153 0.1 μm thick was deposited by vacuum evaporation and then patterned, the organic palladium compound solution (ccp4230 available from Okuno Seiyaku K. K.) was applied thereonto by spin coating with the spinner, and it was baked at 300° C. for ten minutes (FIG. 17B). The conductive film 4 thus made of fine particles of Pd as a principal element had the thickness of 10 nm and the sheet resistance of $2\times10^4$ Ω/□.

(Step-g)

Figure 17C:
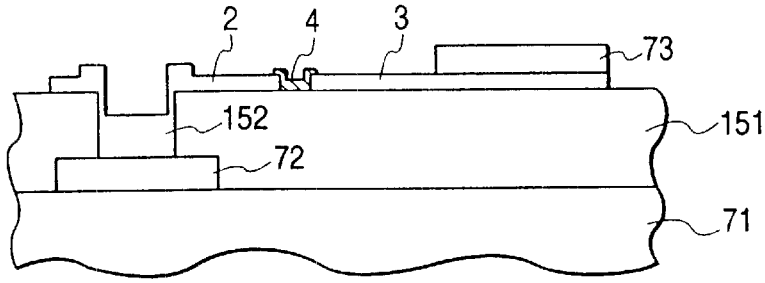

The Cr film 153 and the conductive film 4 after the baking were etched with an acid etchant and lifted off, thereby forming the conductive film 4 in the desired pattern (FIG. 17C).

(Step-h)

Figure 17D:
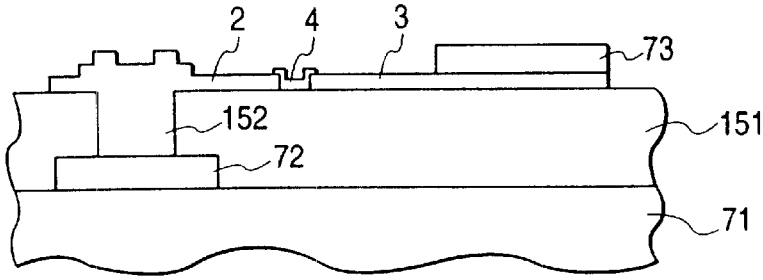
Figure 18:
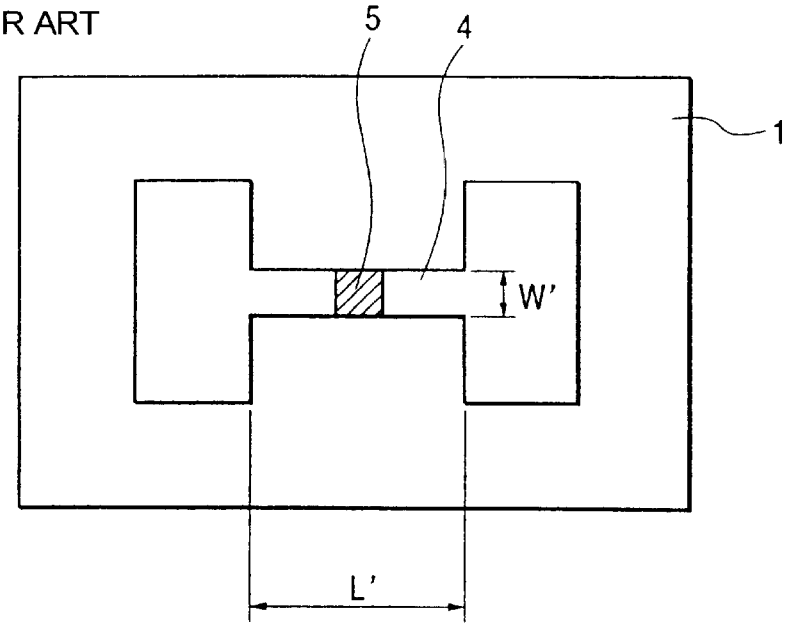
FIG. 18 PRIOR ART
FIG. 18 is a schematic diagram of the surface conduction electron-emitting device of the prior art example.

A resist pattern was formed so as to apply a resist to the other portions than the portions of contact holes 152, and then Ti and Au were successively deposited thereon in the thickness of 5 nm and in the thickness of 0.5 μm, respectively, by vacuum evaporation. Then unnecessary portions were removed by lift-off, thereby filling the contact holes 152 (FIG. 17D).

According to the above steps, the lower wires 72, the interlevel insulating layer 151, the upper wires 73, the device electrodes 2, 3 and the conductive film 4 were formed on the insulating substrate 71.

Then the electron source substrate fabricated was guided into the measurement-evaluation apparatus of FIG. 4, as described in Example 1.

The inside of the vacuum vessel in which the electron source substrate was placed was evacuated by the vacuum pump. After the pressure reached a sufficient vacuum degree, the voltage was placed between the device electrodes 2, 3 of the electron-emitting device via Dx1 and Dy1 in FIG. 14, thereby performing the forming operation of the conductive film 4. The forming operation was carried out by successively supplying the pulse waves to Dx1 to Dxm. The terminals Dy1 to Dyn were grounded. The voltage waves in the forming operation were the same as those in FIG. 5B.

In the present example the forming operation was carried out under such conditions that T1 was 1 msec, T2 was 10 msec, and the vacuum atmosphere was about $1.3\times10^{-4}$ Pa. The first gap was created in part of the conductive film 4 in this manner.

Then evacuation was carried on before the vacuum degree inside the vacuum vessel reached the order of $10^{-6}$ Pa and thereafter hexane ($C_6H_{14}$) was introduced as organic molecules into the vacuum vessel so that the total pressure became $1.3\times10^{-4}$ Pa. The activation operation was carried out by placing the voltage with the waveform illustrated in FIG. 13 and the peak value of 14 V between the device electrodes 2, 3 of the electron-emitting devices. Since hexane was used as organic molecules, a carbon film containing no nitrogen was deposited on each device.

After this, the electron source substrate was taken out once to the atmosphere and then was set in the plasma process apparatus to be subjected to the nitrogenization treatment (nitrogen introducing step). In the nitrogenization process, the plasma process was carried out in a similar fashion to that in Example 1. The plasma process was carried out for fifteen minutes under such conditions that the total pressure was about 4 Pa, the substrate temperature was 200° C., the ratio of gases was Ar:$N_2$ 1:1 in the present example, and the plasma power was 1 W/cm$^2$.

Through the forming, activation, and nitrogenization operations as described above, the electron-emitting regions 5 were formed and nitrogen was introduced into the carbon films. As a result of the nitrogen injection under the above conditions, the N/C ratio was 13/100. The electron source substrate was produced as described above.

Next described referring to FIG. 8 and FIG. 9A is an example of construction of a display device using the electron source substrate produced as described above.

The substrate 71 having the devices fabricated as described above thereon was fixed on the rear plate 81, and the face plate 86 (in which the fluorescent film 84 and metal back 85 were formed on the inner surface of glass substrate 83) was placed 5 mm above the electron source substrate 71 through the support frame 82. Frit glass was applied to joint parts between the face plate 86, the support frame 82, and the rear plate 81 and was baked at 400° C. in the atmosphere for ten minutes, thereby effecting sealing thereof. The fixing of the electron source substrate 71 to the rear plate 81 was also conducted with the frit glass.

In the present example numeral 74 of FIG. 8 denotes the electron-emitting devices having the carbon-containing films comprising nitrogen.

The fluorescent film 84 is only of the fluorescent material in the monochrome case, and the present example employed the stripe pattern of fluorescent material. The fluorescent film 84 was produced by first forming the black stripes, and then coating the gap portions between them with the fluorescent materials of the respective colors. The material for the black stripes was a material whose principal component was graphite commonly widely used. The method for applying the fluorescent materials onto the glass substrate 83 was the slurry process.

The metal back 85 was normally provided on the inner surface side of the fluorescent film 84. The metal back was made after the fabrication of the fluorescent film by carrying out the smoothing operation (normally called filming) of the internal surface of the fluorescent film and thereafter depositing A1 thereon by vacuum evaporation.

In certain cases the face plate 86 is provided with a transparent electrode (not illustrated) on the outer surface side of the fluorescent film 84 in order to enhance the electrical conduction property of the fluorescent film 84. However, the present example achieved the sufficient electric conduction property by only the metal back, and thus the transparent electrode was not provided.

On the occasion of the aforementioned sealing, sufficient position alignment was conducted in order to achieve correspondence between the electron-emitting devices and the fluorescent materials of the respective colors in the color case.

For carrying out the stabilization operation next, the whole panel was evacuated with heating at 30° C. and the temperature was then decreased to the room temperature. After the inside pressure was reduced to approximately $10^{-7}$ Pa, the exhaust pipe not illustrated was heated by a gas burner to be fused, thus effecting encapsulation of the envelope.

In the last step, in order to maintain the pressure after the encapsulation, a getter operation was carried out by high-frequency heating.

In the image displaying apparatus of the present example completed as described above, the scanning signal and modulation signal were applied each by the unrepresented signal generating means to each electron-emitting device through the external terminals Dox1-Doxm, Doy1-Doyn, whereby the devices emitted electrons. The high voltage of not less than 5 kV was applied to the metal back 85 or to the transparent electrode (not illustrated) through the high-voltage terminal 87 to accelerate the electron beams and to make the beams collide with the fluorescent film 84, so as to bring about excitation and luminescence thereof, thereby displaying the image.

The image display device in the present example was able to stably display good images with sufficiently satisfactory luminance (about 180 fL) as a television monitor over a long period.

Example 3

The present example shows an example of the display device constructed so as to display image information supplied from a variety of image information sources including the television broadcasting system. The image-forming apparatus illustrated in FIG. 8 was driven by the driving circuit shown in FIG. 10 to achieve the display according to the TV signals of the NTSC system.

In the display apparatus of the present example, it is particularly easy to decrease the thickness of the display panel having the surface conduction electron-emitting devices as electron beam sources, and thus the depth of the display apparatus can be decreased. In addition, the display panel having the surface conduction electron-emitting devices as electron beam sources is readily formed in a large panel size, has high luminance, and is also excellent in field angle characteristics, so that the display apparatus of the present example can display images of strong appeal with full presence and with good visibility.

The display apparatus in the present example was able to stably display good TV images according to the TV signals of the NTSC system.

As described above, the carbon-containing film (carbon film) connected to the electrode kept at the higher potential during the driving was made to contain nitrogen according to the present invention, whereby the electron-emitting device was obtained with the performance of being capable of extracting stable electron emission current over a long period.

Further, when the electron source or the image-forming apparatus is constructed using the electron-emitting devices of the present invention with high efficiency and stable characteristics over a long period, the devices are very stable even in the case of the array of many electron-emitting devices. Particularly, when the image display apparatus was constructed with the fluorescent material, the image display apparatus was obtained with high luminance, with stability over a long period, and with high quality.

What is claimed is:

1. An electron-emitting device comprising:

(a) first and second carbon films disposed on a substrate; and (b) first and second electrodes electrically connected to the respective carbon films, wherein a higher voltage is applied to the second electrode than to the first electrode, thereby causing an electron emission, and wherein said carbon film connected to said second electrode comprises nitrogen.

2. The electron-emitting device according to claim 1, wherein a ratio of nitrogen atoms in said carbon film to carbon atoms in said carbon film is not less than 2/100.

3. The electron-emitting device according to claim 1, wherein a ratio of nitrogen atoms in said carbon film to carbon atoms in said carbon film is greater than 5/100.

4. The electron-emitting device according to claim 2 or 3, wherein the ratio of nitrogen atoms in said carbon film to carbon atoms in said carbon film is not more than 15/100.

5. An electron source comprising a plurality of electron-emitting devices, each being an electron-emitting device as set forth in any one of claims 1, 2, or 3, on a substrate.

6. The electron source according to claim 5, comprising a plurality of rows of the electron-emitting devices, each row comprising a first wire as a common wire connected to the first electrodes of the respective electron-emitting devices, and a second wire as a common wire connected to the second electrodes of the respective electron-emitting devices; and modulation means for modulating electron beams emitted from the electron-emitting devices.

7. The electron source according to claim 5, wherein the plurality of electron-emitting devices are connected in a matrix to a plurality of X-directional wires and Y-directional wires electrically insulated from each other.

8. An image-forming apparatus comprising an electron source and an image-forming member, wherein said electron source is the electron source as set forth in claim 7.

9. The electron-emitting device according to claim 1, wherein the first carbon film and the second carbon film are connected at a part.

10. An electron source comprising a plurality of electron-emitting devices, each being an electron-emitting device as set forth in claim 9, on a substrate.

11. An image-forming apparatus comprising an electron source and an image-forming member, wherein said electron source is the electron source as set forth in claim 6.

* * * * *

UNITED STATES PATENT AND TRADEMARK OFFICE

CERTIFICATE OF CORRECTION

PATENT NO. : 6,617,773 B1 
DATED : September 9, 2003
INVENTOR(S) : Keisuke Yamamoto et al.

It is certified that error appears in the above-identified patent and that said Letters Patent is hereby corrected as shown below:

Title page,
Item [56], References Cited, OTHER PUBLICATIONS,
"M. Geis, et al.," reference, "$O_2C_S$" should read -- $O_2$, and $C_S$ --; and "Left." should read -- Lett --;
"K. Okano et al.," reference, "Okano et" should read -- Okano, et --; and "Chemical–vapour–deposited" should read -- Chemical-Vapour-Deposited --;
"E. Joon Chi, et al.," reference, "treatment" should read -- Treatment --;
"A. Weber, et al.," reference, "(16(3)" should read -- 16(3) --;
"C.A. Spindt et al.," reference, "Spindt et" should read -- Spindt, et --;
"W. P. Dyke et al.," reference, "Dyke et" should read -- Dyke, et --;
"M. Elinson, et al.," reference, "et al." should read -- et al., --; and "1972 pp." should read -- 1972, pp. --;
"M. Hartwell et al.," reference, "Hartwell et" should read -- Hartwell, et --;
"H. Araki, et al.," reference, "1983;" should read -- 1983, --;
"A. Gehan, et al." reference, "et al." should read -- et al., --; and "Lett" should read -- Lett. --;
"E Joon Chi, et al.," reference, "Technolg." should read -- Technol. --;
"A Weber et al.," reference, "A Weber et al.," should read -- A. Weber, et al., --; and "Technol. a" should read -- Technol. A --;
"M.W. Geis et al.," reference, "Geis et" should read -- Geis, et --; and "2B" should read -- Lett. 2B --;
"K. Okano, et al.," reference, "Nitorgen-doped" should read -- Nitrogen-doped --; "Chemical-Vapour-Deposited" should read -- Chemical-Vapor-Deposited --; and "diamond" should read -- Diamond --.

Column 3,
Line 19, "been" should be deleted; and
Line 23, "large" should read -- largely --.

Column 5,
Line 41, "to" should read -- to as --.

Column 7,
Line 41, "a" should be deleted; and
Line 52, "pm" should read -- $\mu$m --.

Column 9,
Line 2, "pm" should read -- $\mu$m --; and
Line 6, "an" should read -- a --.

UNITED STATES PATENT AND TRADEMARK OFFICE

CERTIFICATE OF CORRECTION

PATENT NO. : 6,617,773 B1
DATED : September 9, 2003
INVENTOR(S) : Keisuke Yamamoto et al.

It is certified that error appears in the above-identified patent and that said Letters Patent is hereby corrected as shown below:

Column 14,
Line 49, "long" should read -- long of a --.

Column 16,
Line 51, "Here" should read -- Here, --.

Column 17,
Line 26, "¶ Numerals" should read -- Numerals --.

Column 24,
Line 66, "instable" should read -- unstable --.

Column 26,
Line 63, "Ar:$N_2$ 1:1" should read -- Ar:$N_2$ = 1:1 --.

Column 27,
Line 50, "30°C." should read -- 300°C. --.

Signed and Sealed this

Twenty-sixth Day of July, 2005

JON W. DUDAS
*Director of the United States Patent and Trademark Office*